US005664887A

United States Patent [19]

LaFleur

[11] Patent Number: 5,664,887

[45] Date of Patent: *Sep. 9, 1997

[54] BULK BAG WITH RESTRAINER

[75] Inventor: Lee LaFleur, Manistee, Mich.

[73] Assignee: Custom Packaging Systems, Inc., Manistee, Mich.

[ * ] Notice: The term of this patent shall not extend beyond the expiration date of Pat. No. 5,328,268.

[21] Appl. No.: 377,318

[22] Filed: Jan. 24, 1995

Related U.S. Application Data

[60] Division of Ser. No. 252,186, Jun. 1, 1994, Pat. No. 5,421,804, which is a continuation-in-part of Ser. No. 969,741, Oct. 30, 1992, Pat. No. 5,328,268.

[51] Int. Cl.[6] ..... B65D 33/02

[52] U.S. Cl. ..... 383/119

[58] Field of Search ..... 383/17, 19, 119

[56] References Cited

U.S. PATENT DOCUMENTS

| | | | |
|---|---|---|---|
| 3,112,044 | 11/1963 | Larsen et al. | 220/18 |
| 3,472,414 | 10/1969 | Rodrigues | 220/3 |
| 3,774,812 | 11/1973 | Lemelson | 383/19 |
| 4,193,510 | 3/1980 | Weston | 220/5 |
| 4,426,015 | 1/1984 | Preston et al. | 217/43 |
| 4,596,040 | 6/1986 | LeFleur et al. | 383/7 |
| 4,781,475 | 11/1988 | LaFleur | 383/119 |
| 4,790,029 | 12/1988 | LaFleur et al. | 383/41 |
| 4,798,572 | 1/1989 | LaFleur et al. | 493/195 |
| 4,966,310 | 10/1990 | Hawkins | 383/19 |
| 5,073,035 | 12/1991 | Williams | 383/17 |
| 5,104,236 | 4/1992 | LaFleur | 383/17 |
| 5,165,802 | 11/1992 | Derby | 383/17 |
| 5,222,812 | 6/1993 | Cuddy et al. | 383/119 |
| 5,244,280 | 9/1993 | Porter et al. | 383/17 |
| 5,316,387 | 5/1994 | Polett et al. | 383/119 |
| 5,328,267 | 7/1994 | Cuddy et al. | 383/17 |
| 5,328,268 | 7/1994 | LaFleur | 383/119 |
| 5,468,528 | 11/1995 | Schnaars et al. | 383/17 |

FOREIGN PATENT DOCUMENTS

| | | |
|---|---|---|
| 0325625 | 2/1930 | United Kingdom . |
| 0561819 | 6/1944 | United Kingdom . |
| WO 92/14660 | 9/1992 | WIPO . |

*Primary Examiner*—Stephen P. Garbe

*Attorney, Agent, or Firm*—Barnes, Kisselle, Raisch, Choate, Whittemore & Hulbert

[57] ABSTRACT

A collapsible bulk bag which when filled with material has a generally cubical configuration with a pair of end walls and rectangular sidewalls extending between them with all of the walls being of a flexible material. Bowing and bulging of the sidewalls from a planar configuration is retarded and restrained by loops of cord operably connected with the sidewalls. Preferably the loops of cord having portions inside the bag extending obliquely between adjacent sidewalls when the bag is filled. Method and apparatus for making the bag with the double knotted loops of cord are also disclosed.

26 Claims, 15 Drawing Sheets

BULK BAG WITH RESTRAINER

REFERENCE TO RELATED APPLICATION

This application is a division of Ser. No. 08/252,186, filed Jun. 1, 1994, now U.S. Pat. No. 5,421,804 which is a continuation-in-part of my application, Ser. No. 969,741, filed Oct. 30, 1992, now U.S. Pat. No. 5,328,268, issued Jul. 12, 1994.

FIELD OF THE INVENTION

This invention relates to shipping and storage containers and more particularly a large bulk bag of a flexible material.

BACKGROUND OF THE INVENTION

Previously, granular and particulate materials, such as grains, flours, resins, pourable and dry cyanide, etc. have been packaged, shipped and stored in large bulk bags which may contain as much as a ton or more of material. Pourable liquids have also been packaged, shipped and stored in large bulk bags, usually of a woven fabric material by disposing therein a complementary bag or liner made of a flexible plastic film, such as polyethylene. Herein, both these bulk bags and liners will be referred to as bags since they have essentially the same construction, configuration and arrangement and differ in only the particular flexible material of which they are made which is usually a woven fabric and a synthetic resin or plastic film respectively. Some of these bulk bags are flexible and when empty can be folded to a generally collapsed condition.

Flexible bulk bags with generally rectangular ends interconnected by generally rectangular side walls are disclosed and claimed in U.S. Pat. Nos. 4,596,040 and 4,790,029. These bags are made of a woven fabric, plastic film or other flexible material with gusseted panels forming a first pair of opposed sidewalls received between a second pair of opposed sidewalls so that when empty they can be readily folded to a generally flat condition. Usually, these bags have a spout at one or both ends for filling and emptying them. When filled with a flowable material, a plurality of these bags can be stacked side-by-side and one on top of another.

Such a flexible bulk bag of a woven fabric with reinforcing strips woven in the fabric and extending along the side edges and through the central portion of the top, bottom and sidewalls of the bag to thereby reinforce them is disclosed and claimed in U.S. Pat. No. 5,104,236.

For some applications, the sidewalls of a flexible bulk bag are strengthened or reinforced by a band of a flexible fabric material disposed outside or inside the bag and bearing on the sidewalls as disclosed and claimed in U.S. Pat. No. 4,781,475.

While these bags are generally satisfactory for a wide variety of applications, when filled, their sidewalls bulge or bow outwardly and the side edges or corners tend to pull inwardly so that collectively in cross section the sidewalls have a generally elliptical or circular configuration. Thus, hen a plurality of these filled bags are stacked side-by-side with a central portion of their adjacent sidewalls abutting one another, there are void spaces or openings between portions of the sidewalls of adjacent bags. These voids or waste spaces reduce the quantity of material that can be stored in a given floor area or a given cubical volume of storage space, and increase the number of bags required to package and store a given quantity of material. This increases packaging, shipping, storage and handling costs.

One commercially available attempt to solve this problem is a bulk bag of a woven fabric with baffles therein of a woven fabric connected adjacent their side edges to the sidewalls of the bag by stitching. The baffles and stitching extend essentially from the bottom to the top of the sidewalls or essentially across their full vertical height. Each baffle has holes cut through it so that the entire bag can be filled with material and when the bag is filled each baffle is generally planar and extends substantially the entire distance between the top and bottom of the bag. These bags are relatively expensive to manufacture and assemble and because the baffles restrain the flow of material these bags are not entirely satisfactory in use and sometimes the baffles do not adequately restrain the bulging or bowing of their associated sidewalls of the bag.

Moreover, for some applications, the flexible bag is placed inside a generally cubical container having rectangular ends and rectangular sidewalls with at least the sidewalls and the bottom end being substantially rigid and inflexible. While filled the flexible bulk bag must be removed from this rigid cubical container. Thus, it is necessary to make the maximum perimeter of the sidewalls of the filled bag small enough so that at most there is only a relatively small surface area in the central portion of each sidewall bearing on the adjacent rigid sidewall of the container. Otherwise, frictional forces between the sidewalls of the bag and the container would inhibit removal of the filled bag from the container. These filled bags in rigid outer containers not only have void or wasted space between each filled bag and its associated container and the attendant increased costs associated therewith but also require careful sizing of the maximum perimeter of each filled bag to insure it can be removed from its rigid container while still minimizing the amount of void or waste space.

SUMMARY OF THE INVENTION

A bulk bag with generally rectangular ends and generally rectangular sidewalls of a flexible material with cords engaging or operably associated with and extending between the sidewalls so that when the bag is filled they restrain and retard the sidewalls from being bowed and bulged outwardly by the contents of the bag. Preferably, the cords engage pairs of adjacent sidewalls and when the bag is filled extend in the bag obliquely between each pair of adjacent sidewalls to restrain and retard the sidewalls from being bowed and bulged outwardly by the contents of the bag. Preferably the cords are arranged in spaced apart closed loops disposed generally parallel to the bottom end wall with a portion extending along the outside of each sidewall in a generally central region between the adjacent side edges or corners of the bag. Alternatively, the cords may be arranged in closed loops which when the bag is filled are disposed generally transverse to an end wall and have portions outside and extending along adjacent sidewalls in their central regions. Alternatively, the cords may be arranged in closed loops extending between pairs of opposed sidewalls.

If it is desired that the cords be received entirely within the bag, they can be carried by pleats of material in or on the sidewalls and disposed within the bag. Alternatively the loops can be carried by a closed band or loop of flexible material disposed inside the bag closely adjacent its sidewalls and preferably connected to the sidewalls. Also, the cords can be disposed in one bag or liner complementary to and received within and preferably sealed to a second bag or liner to provide an inner bag or liner with cords received in a reinforcing outer bag or liner without any cords. If desired, the location in which a cord passes through the bag can be reinforced, such as with tape, a pleat, patch, outer bag, strips of woven fabric, and the like.

Preferably, before the cords are installed, the bag is fabricated with its end walls and sidewalls connected together and folded into a generally flat configuration with one pair of opposed sidewalls being gusseted and folded between another pair of opposed sidewalls disposed in a generally flat and parallel relation. To form a loop, a needle threaded with a piece of cord is passed through the sidewalls and gusseted panels on one side of the folded bag and then through the sidewalls and the gusseted panels on the other side of the folded bag, and then the free ends of the cord are tied or otherwise connected together to provide a closed loop of the appropriate length.

If desired, a loop can be formed with only one pass of the needle by first further folding the flat bag over itself along its longitudinal axis so that all of its gusseted panels overlie one another and then passing only once a needle threaded with a cord through all of the sidewall and gusseted panels and then tying or otherwise connecting together the free ends of the cord to provide a closed loop of the appropriate length.

Alternatively, the bag can be only partially fabricated and assembled so that it has at least one completely open end. The partially assembled bag is opened and disposed over a fixture to retain each sidewall in a generally flat condition and at a generally right angle to its adjacent sidewalls. To form a loop, a needle threaded with a cord is passed through the sidewalls and then the free ends of the cord are tied or otherwise connected together to provide a closed loop of the appropriate length. Preferably, the fixture is indexed to facilitate passing the needle through the sidewalls.

An alternative bulk bag can be provided which is formed from two sections where one section comprises an inner bag having a top wall forming a spout and having an open bottom. The other section comprises an outer bag having a bottom wall and an open top wherein the inner bag is inserted into the outer bag and the two portions stitched together to form a double walled bag. In this configuration, the inner bag can be formed with the loops so that the cord does not extend through the outer bag walls.

Alternatively, the bag may be formed with cord webbing at each corner thereof which is formed from a plurality of cord sections attached at each end to a pair of parallel elongated fabric strips. The fabric strips are attached to the inside of the walls of the bag.

Additionally, a bulk bag can be provided in which each loop is formed by two sections of cord wherein the ends of each section of cord are secured to one another by knots, one knot thus being disposed on one side of the bag and the other knot on an opposed side of the bag. Furthermore, a new cord having acetate tips at each end is provided to prevent the knots from slipping and coming undone.

Furthermore, a liner can be provided in which gusset straps are die cut from the liner sidewalls with the ends of adjacent gusset straps secured together so that they extend across the corners of the bag.

In another form, a liner of coated fabric material may be provided having a closed bottom and open top and a separate thin filmed top with a spout secured at the top end. If desired, a separate thin filmed bottom with a spout may also be provided and secured to an open ended bottom end of the liner.

A stitching method and machine and associated cord-carrying needle is also preferably provided in which the one of the free ends of two sections of cord are simultaneously inserted in one stroke through a folded bag in proper spaced relation and automatically released on the needle retraction stroke to provide a plurality of associated pairs of cords with free ends on each side of the folded bag which are then knotted together to form the associated double knotted loops.

Objects, features and advantages of this invention are to provide an improved flexible bulk bag and improved method and apparatus for constructing the same, in which the sidewalls do not become substantially bowed or substantially bulge when the bag is filled with granular material, which reduces the cost of packaging, shipping, storing and handling bulk bags filled with granular and liquid materials, decreases the number of bags and the amount of space required to store a given quantity of bulk material, and is of relatively simple design and economical manufacture and assembly.

BRIEF DESCRIPTION OF THE DRAWINGS

These and other objects, features and advantages of this invention will be apparent from the following detailed description of the best mode, appended claims and accompanying drawings in which:

DETAILED DESCRIPTION

Figure 1:
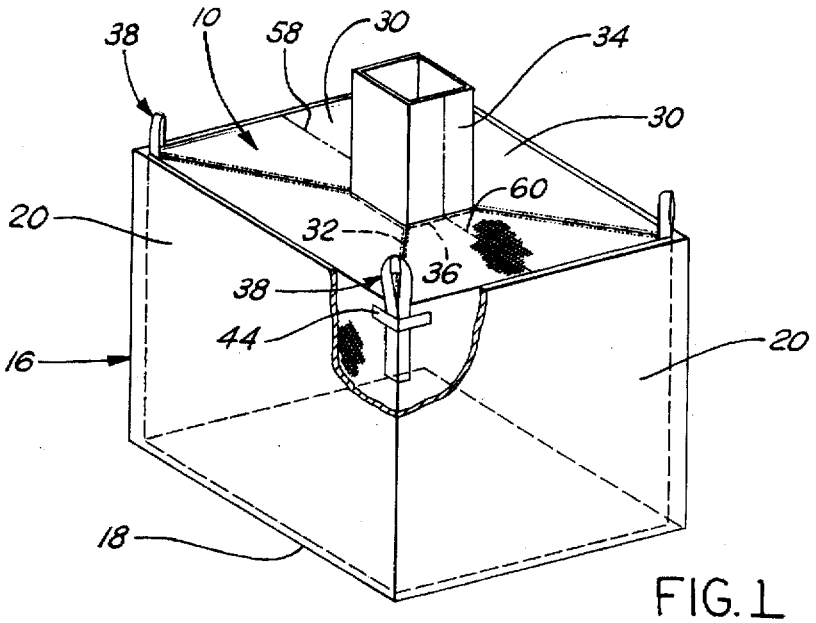
FIG. 1 is a perspective view of a bulk bag embodying this invention disposed in a container with rigid sidewalls.
Figure 2:
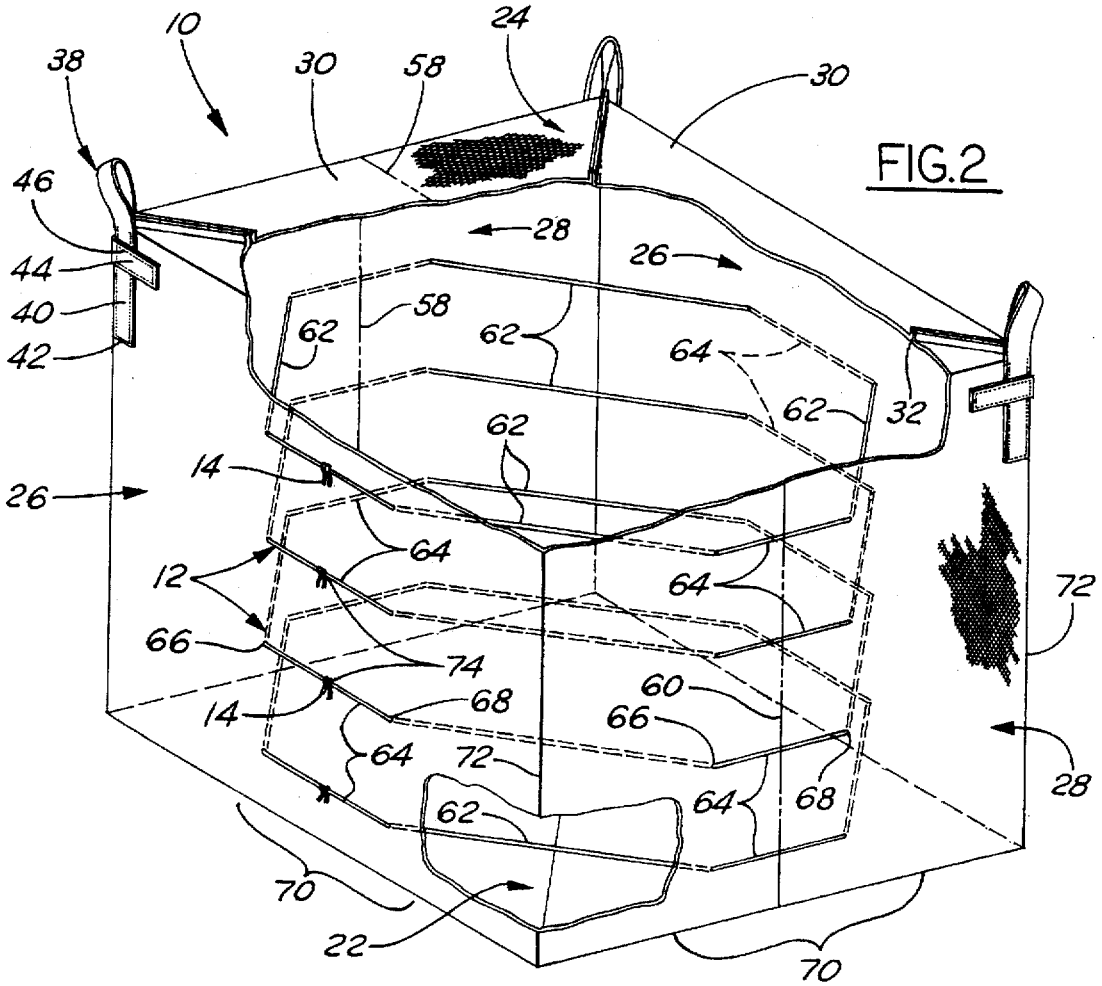
FIG. 2 is a perspective view with portions broken away of the bulk bag of FIG. 1 with loops of restrainer cords.

Referring in more detail to the drawings, FIGS. 1 & 2 illustrate a bag 10 with loops 12 of cord 14 embodying this invention disposed in a complementary rigid container 16 with the sidewalls and ends of the bag in the position they would assume when the bag is filled with a granular material. The container 16 is rectangular and preferably cubical and has a rectangular rigid bottom wall 18 and four rectangular rigid sidewalls 20, all connected together along their adjoining edges. The bottom 18 and sidewalls 20 are made of a substantially rigid and inflexible material, such as wood or sheet metal. The bulk bag 10 is collapsible and made of a flexible material, such as a woven fabric of canvas, polypropylene, polyethylene, etc.

As shown in FIGS. 1 and 2, the bag has rectangular and preferably square end walls 22 & 24 connected by two pair of opposed rectangular sidewalls 26 & 28. Preferably, each end wall 22 & 24 is formed by four triangular portions 30 connected together along their adjacent edges by lines of stitches 32. Preferably, the sidewalls and ends are formed from a tubular blank 33 (FIG. 18) of fabric material with each triangular portion being homogeneously integral with a sidewall. A tubular spout 34 is disposed in the center of the top wall 24 and attached to the adjacent triangular portions by lines of stitches 36. Preferably, a lifting strap 38 (often referred to in the industry as a lifting loop but hereinafter referred to as a "lifting" strap) is provided at each upper corner by a web 40 formed into a loop with its free ends attached by stitches 42 to the sidewalls adjacent each corner. The lifting strap is reinforced by a web 44 secured by stitches 46 to the sidewalls.

Figure 18:
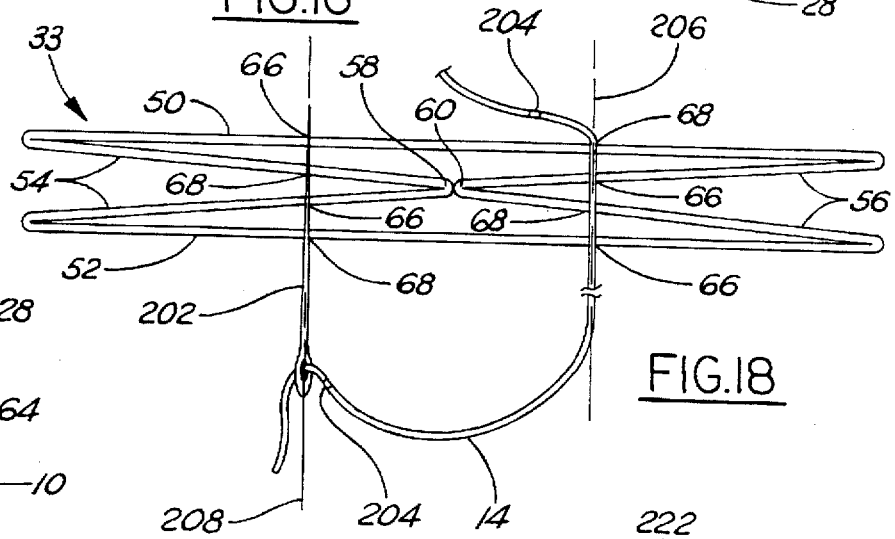
FIG. 18 is an end view of a folded bag illustrating use of a needle threaded with a cord to form a loop of the bag of FIG. 2.

Preferably, the bag is constructed so that when it is empty, it can be folded into a generally flat and compact configuration which, as shown in FIG. 18, has two flat overlying panels 50 & 52 which are interconnected by inwardly folded gusset panels 54 & 56 which have longitudinal fold lines 58 & 60 disposed adjacent each other and extending generally parallel to the side edges of the bag. When the bag is opened and filled, the panels 50 & 52 form the two generally opposed sidewalls 26 and the gusset panels 54 & 56 form the other two generally opposed and interconnecting sidewalls 28.

Preferred constructions of the flexible bag are disclosed and described in detail in U.S. Pat. Nos. 4,798,572 and 4,596,040, the disclosures of which are incorporated herein by reference and hence the construction of the bag 10 per se will not be described herein in further detail.

In accordance with this invention, and as shown in FIG. 2, when the bag 10 is filled with granular material, outward bowing and bulging of the central region of each side panel is restrained and substantially retarded by a plurality of loops 12 of cord 14 which preferably substantially lie in planes which are spaced apart and preferably generally parallel to the bottom wall 22 of the bag. Each loop 12 of cord is arranged so that when the bag is filled, it has a portion 62 extending inside the bag obliquely between each pair of adjacent sidewalls and interconnecting portions 64 which pass through a sidewall and extend along the outside of the sidewall.

Preferably, the portions extend along the outside of a sidewall and pass through it at locations 66 & 68 in the central region 70 or mid portion between the side edges of the sidewalls or corners 72 of the bag. To provide a closed loop 12, portions of each cord 14 are securely connected together preferably by a knot 74 adjacent the free ends of the cord. Preferably, each closed loop 12 has substantially the same overall length which is the sum of the lengths of its individual portions 62 & 64. The overall length is selected and preferably predetermined to retain each sidewall 26 & 28 in a generally planar configuration when the bag is filled. If desired, the knot 74 can be disposed within the bag by either moving or shifting the closed loop 12 relative to the sidewalls of the bag to move the knot through the wall and dispose it inside the bag or when initially forming the loop having the free ends terminate inside the bag and then tying the knot inside the bag.

Figure 3:
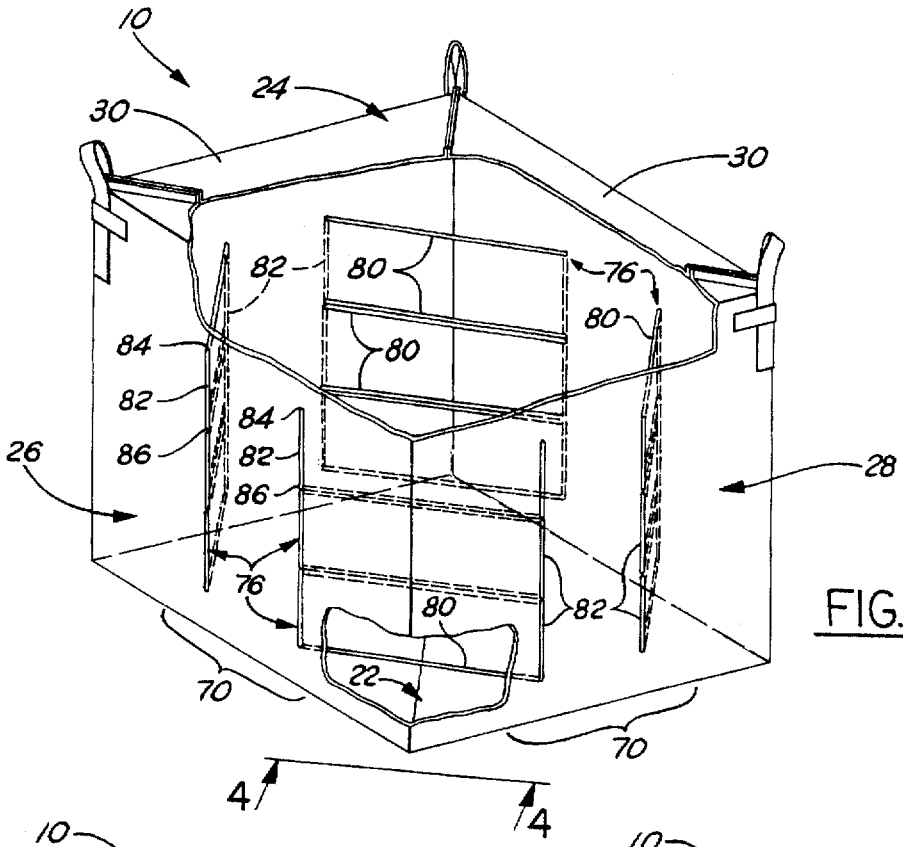
FIG. 3 is a perspective view of a bag with modified loops of restrainer cords embodying the invention.
Figure 4:
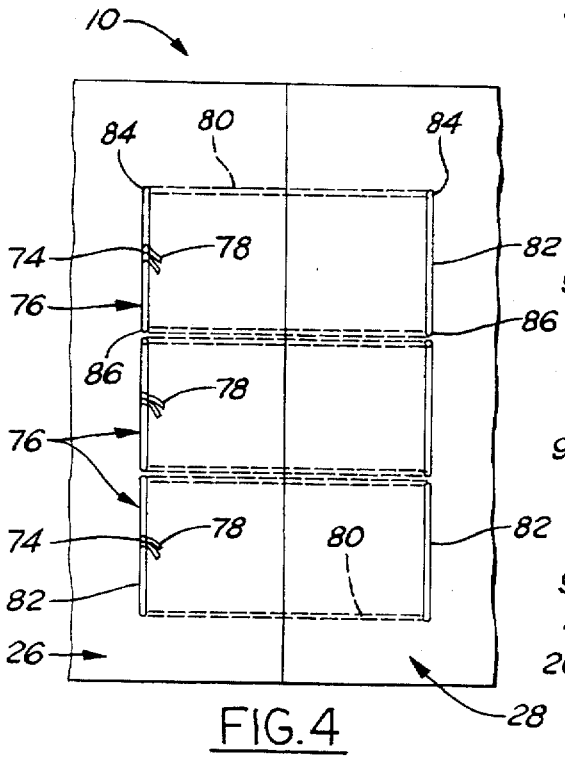
FIG. 4 is a fragmentary side view of a corner of the bag of FIG. 3 taken generally in the direction of the arrows 4—4 in FIG. 3.

FIGS. 3 and 4 illustrate a bag 10 with a modified arrangement of loops 76 of cord 78 which when the bag is filled with granular material restrain and retard bowing and bulging of the sidewalls 26 & 28. Each loop 76 of cord has two portions 80 which when the bag is filled extend obliquely between a pair of adjacent sidewalls and are interconnected by two portions 82 each passing through one of the sidewalls at locations 84 & 86 in the central regions 70 and extending along the outside of the sidewalls. The obliquely extending portions 80 are spaced apart and preferably extend generally parallel to each other and the bottom wall 22, and the outside portions 82 are preferably generally parallel and extend generally transversely to the bottom end wall and the obliquely extending portions. Preferably, when the bag is filled all the loops 76 in an adjacent pair of sidewalls generally lie in the same plane which is generally perpendicular to the bottom end wall. To provide a closed loop, the free ends of each cord are securely tied together by a knot 74.

Figure 5:
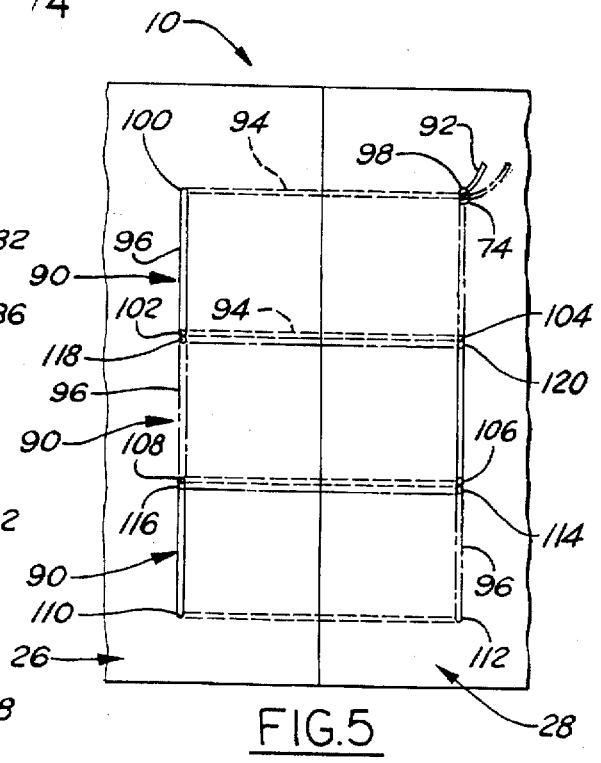
FIG. 5 is a side view similar to FIG. 4 of a bag with another modification of loops of restrainer cords embodying this invention.

FIG. 5 illustrates a bag 10 with a modified arrangement of loops in which all of the loops 90 in each adjacent pair of sidewalls are formed by one piece of cord 92. Each of the three loops has two preferably parallel portions 94 which when the bag is filled extend obliquely between a pair of adjacent sidewalls 26 & 28 and two preferably parallel portions 96 which extend along the outside of the sidewalls in their central regions 70.

As shown in FIG. 5, the cord 92 runs in a generally square tooth pattern from top to bottom and then from bottom to top so that the free ends of the cord terminate adjacent each other. The cord has alternating inside portions 94 extending obliquely between adjacent sidewalls and outside portions 96 extending along the outside and in the central region 70 of one of the sidewalls. More specifically, the cord extends with alternating inside and outside portions through the sidewalls at the locations and in the sequence of 98, 100, 102, 104, 106, 108, 110, 112, 114, 116, 118 and 120 or the reverse thereof. To close the loops, the free ends of the cord 92 are securely connected together, such as by a knot 74.

While this approach of forming all of the loops 90 between an adjacent pair of sidewalls from a single cord 92 is acceptable for some applications, it is believed to be less desirable than the other forms of FIGS. 1 through 4 because it does not restrain and retard bowing and bulging of the sidewalls as well as the forms of FIGS. 1 through 4 do so. With a single cord, as the bag is being filled, the bottom portion of the sidewalls of the bag tend to bow and bulge because the loops adjacent the bottom provide little restraint since they draw additional cord from the upper loops which, in turn, tends to distort the fabric in the upper portions of the bag and draw it toward the center of the bag so that when the bag is completely filled, each sidewall remains distorted and tends to be canted or inclined inwardly, and usually has more bowing and bulging than the sidewalls of the bags of FIGS. 1 through 4.

Figure 6:
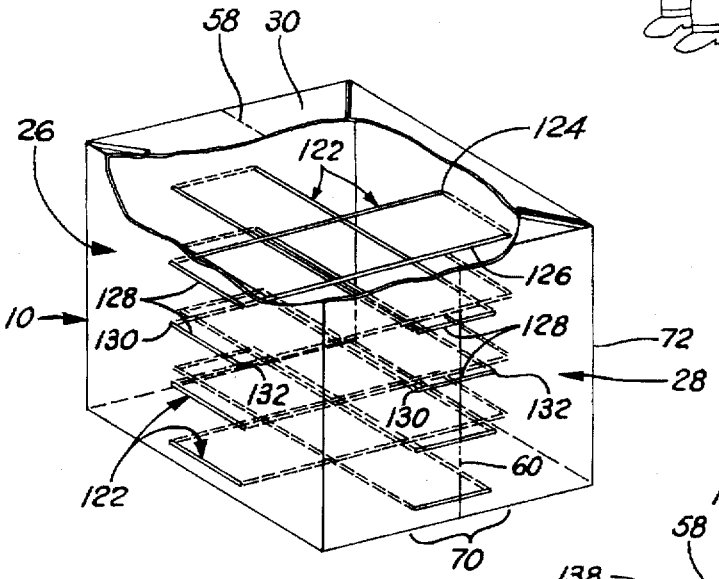
FIG. 6 is a fragmentary perspective view of a bag with a further modification of loops of restrainer cords embodying this invention.

FIG. 6 illustrates a bag 10 with another modified arrangement of loops in which a loop 122 of cord is received in each pair of opposed sidewalls 26 and 28. Preferably, each loop is formed by a separate piece of cord 124 securely tied together by a knot 74 to provide a closed loop. When the bag is filled each loop preferably has a generally rectangular configuration with two parallel portions 126 extending between opposed sidewalls and being interconnected by two transverse portions 128 each passing through an associated sidewall at locations 130 and 132 in the central region 70 of the sidewall and extending on the outside of the sidewall in the central region. Preferably, when the bag is filled all of the loops 122 extend generally horizontally or parallel to the bottom. For restraining all four sidewalls at each selected vertical height, a pair of loops 122 are generally transverse to one another and lie substantially in the same plane extending generally parallel to the bottom of the bag.

Figure 7:
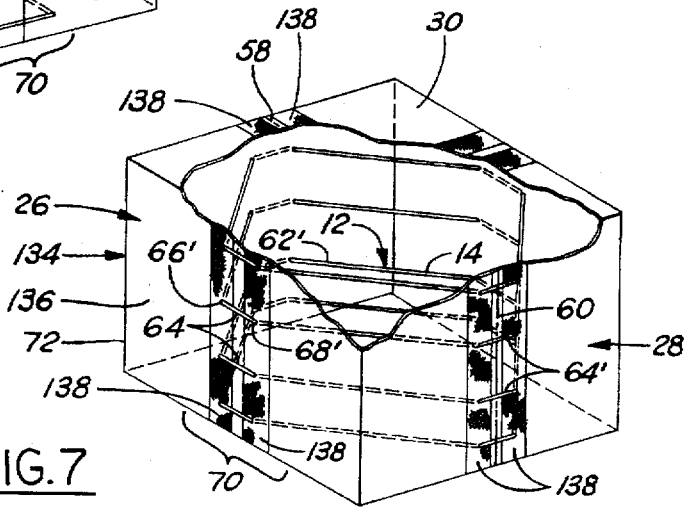
FIG. 7 is a perspective view of a modified bag with loops of restrainer cords embodying this invention.

FIG. 7 illustrates a modified bag 134 embodying this invention which has substantially the same overall construction and arrangement as bag 10 but is made of a woven fabric 136 with reinforcing strips 138 extending longitudinally therein and generally vertically through the central region 70 of each sidewall. If desired, to further reinforce the bag, the reinforcing strips 138 may also extend through the top and bottom walls of the bag which may also have reinforcing strips 138 adjacent each side edge or corner of the bag. The reinforcing strips may be woven in the fabric material by cramming the threads to provide more threads per inch in the areas containing the strips. Since this bag 134 per se is disclosed and claimed in U.S. Pat. No. 5,104,236, the disclosure of which is incorporated herein by reference, the construction and arrangement thereof will not be described in further detail.

Each loop 12 of cord 14 passes through and extends across the reinforcing strips 138 in the central region of each associated sidewall 26 and 28. Passing each loop of cord through the reinforcing strip with its second portions 64' extending on the outside of the sidewall and across the adjacent portion of the strips assures that even if a filled bag is dropped, the cords will not rip, tear or cut through the woven fabric of the sidewalls. Preferably, the cord passes through the strips 138 adjacent their outer edges so that most of each reinforcing strip underlies the portion 64' of the cord to maximize the reinforcement of the locations 66' or 68' where the cord passes through the bag and minimize the tendency of the cord to tear or cut the fabric when the bag is filled, and particularly if a filled bag is dropped. If it is desired to reinforce a particular vertical stratum or layer of a bag, such as the bottom portion, the loops 12 of cord can be more closely spaced together in this portion of the bag than in the remainder of the bag.

If it is desired to use a bag 134 without the reinforcing strips, a plurality of lightweight fabric panel strips (not shown) may be adhesively secured to the outside of the bag wall along its vertical length at spaced locations to cover the holes created by the cords passing through the wall. Preferably, the panel strips extend a distance, for example, one inch, sufficient to cover all of the holes which may have become enlarged due to filling or stacking of the bags, thus preventing any product seepage through the holes.

Figure 8:
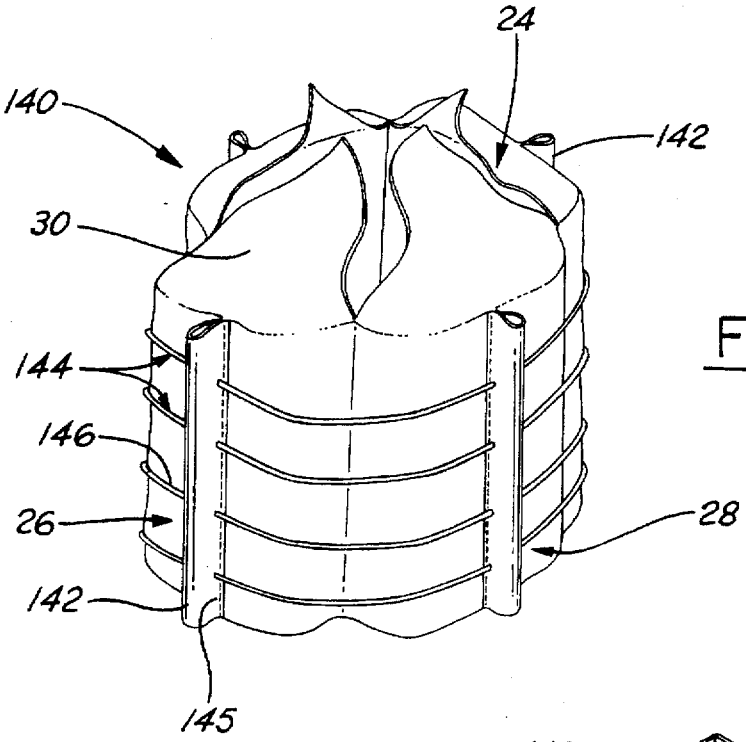
FIG. 8 is a perspective view of another modified bag embodying this invention turned inside out with loops of restrainer cords extending around the exterior of the bag.
Figure 9:
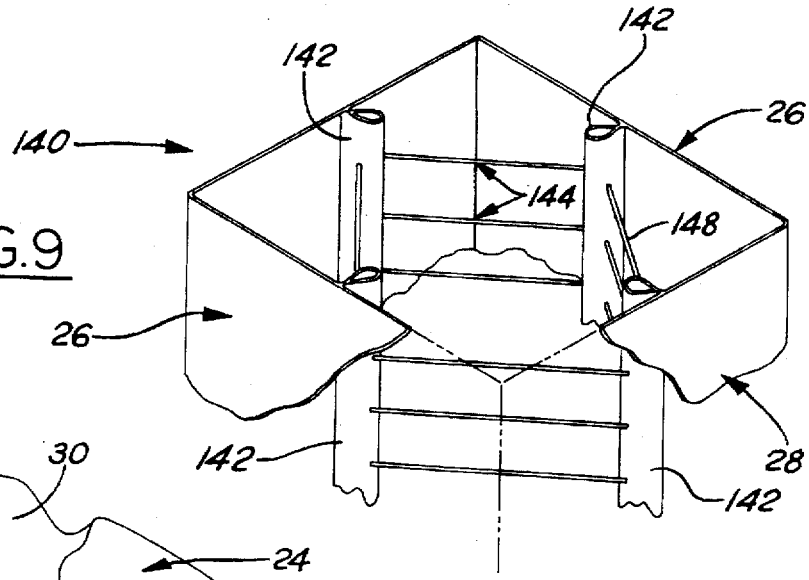
FIG. 9 is a fragmentary perspective view of the bag of FIG. 8 after being inverted or turned right side out to dispose the loops of restrainer cords on the interior of the bag.

FIGS. 8 and 9 illustrate a modified bag 140 which has substantially the same basic construction and arrangement as the bag 10 except that each sidewall 26 and 28 of the bag also has a pleat 142 extending vertically through its central region 70 by which each loop 144 or cord is connected to the sidewall. Preferably, each pleat 142 is formed by folding over portions of the sidewall material into a loop and connecting them together with a line of stitches 145. Preferably, each loop 144 is a separate piece of cord 146 which passes through all four of the pleats 142 and is securely connected together adjacent its free ends, preferably by a knot 74, to provide a closed loop. Preferably, as shown in FIG. 8, the loops 144 of cord are initially formed around the outside of the bag while it is turned inside out and then, as shown in FIG. 9, the bag is inverted or turned right side out so that the pleats 142 and loops 144 of cord are disposed inside the bag. When the bag is filled, each loop is in a generally rectangular or diamond shaped configuration with portions 148 extending obliquely between each pair of adjacent sidewalls to restrain bowing and bulging of the sidewalls by the contents of the bag. Preferably, when the bag is filled each loop 144 of cord is generally parallel to the bottom of the bag. When making this bag with a closed top wall 24 and spout 34, it may be desirable to only partially form the bag with an open end, install loops of the cord and invert the bag before completing the open end by stitching together the triangular portions 30 and attaching any spout. If the lift straps 38 are attached before the loops of cord are installed, the partially formed bag must be turned inside out, the cords installed and then the bag inverted or turned right side out.

Figure 10:
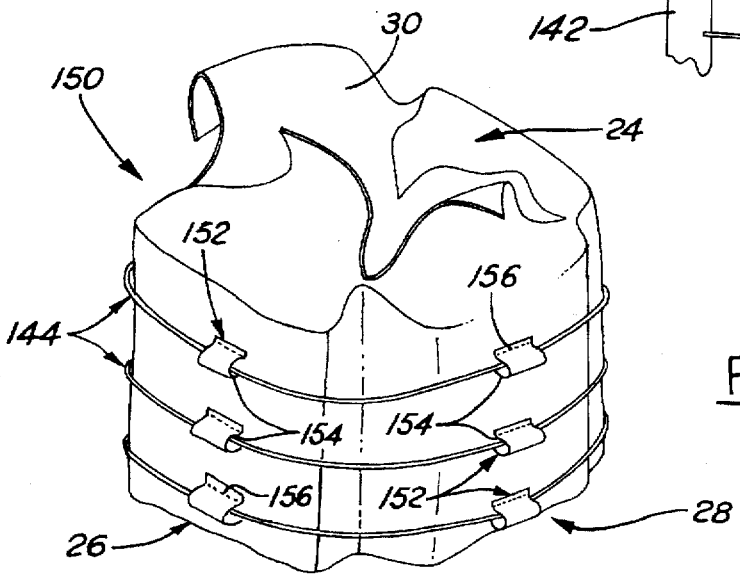
FIG. 10 is a fragmentary perspective view of another modified bag embodying this invention turned inside out with loops of cords carried by modified pleats.

FIG. 10 illustrates another modified bag 150 turned inside out with each loop 144 of cord attached to the central region of each sidewall 26 and 28 by a separate patch 152 of fabric formed into an eyelet 154 and attached to its associated sidewall. Bag 150 has substantially the same basic construction and arrangement as bag 10 with the addition of the patches 152. Each patch may be folded over to form an eyelet 154 and secured by lines of stiches 156 to the sidewalls. To facilitate stitching, each patch 152 can be located and temporarily held on a sidewall by a preferably double faced tape or a tacky adhesive. Alternatively, each patch can be permanently attached to a sidewall by a suitable flexible adhesive. If the bag is made of a plastic film, the patches can also be made of similar plastic film and attached to the sidewalls by heat seals. Preferably, each patch is made of a material with a tensile strength comparable to that of the material of the sidewalls of the bag. Preferably, each loop 144 is a separate piece of cord 146 which passes through the eyelet 154 of a patch on each sidewall 26 & 28 and is securely connected together adjacent its free ends, such as by a knot 74, to provide a closed loop. After the patches are attached and the cords are installed and tied, the bag is inverted or turned right side out so that all of the cords and the patches are disposed on the inside of the bag.

Figure 11:
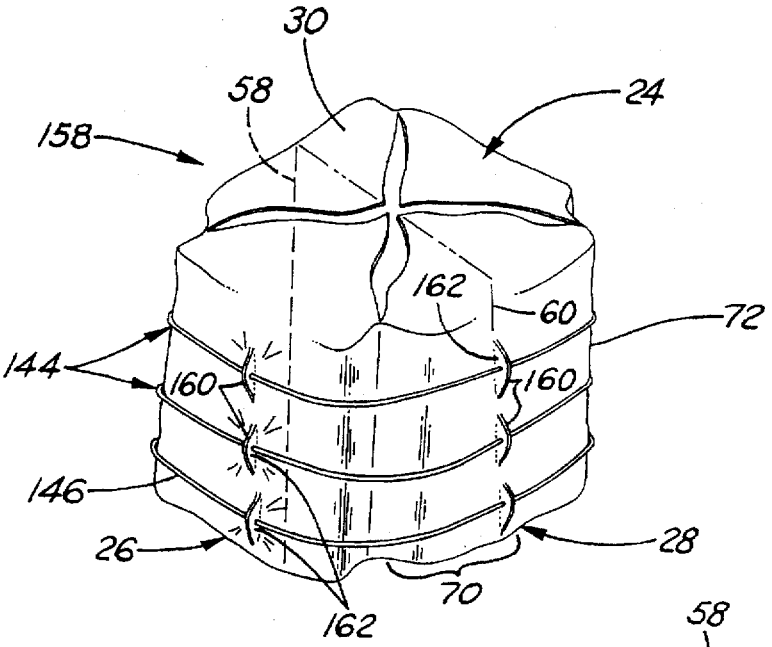
FIG. 11 is a fragmentary perspective view of another bag embodying this invention turned inside out with loops of restrainer cords carried by another modified pleat.

FIG. 11 illustrates a modified bag 158 turned inside out which has substantially the same basic construction and arrangement as the bag 10 except that pinch pleats 160 are formed in each sidewall by doubling over small portions of sidewall material and connecting them together with a generally semi-circular or crescent shaped line of stitches 162. Each loop 144 of cord is formed by a separate cord 146 which passes through pleats 160 on all four sidewalls and is secured together, preferably by a knot 74, adjacent its free ends to provide a closed loop. After the pleats 160 are formed and the cords 144 are installed, the bag is inverted or turned right side out to dispose both the pleats and cords inside the bag. When the bag is filled, each loop 144 of cord is disposed in a generally diamond shaped configuration 148 with portions extending obliquely between each pair of adjacent sidewalls to restrain bowing and bulging of the sidewalls.

Figure 12:
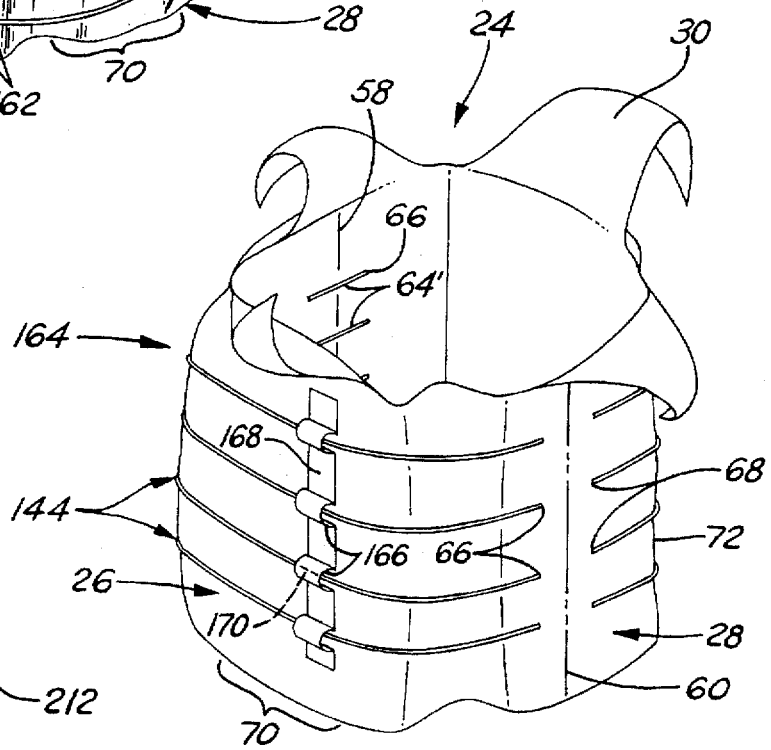
FIG. 12 is a perspective view of another modified bag embodying this invention turned inside out.

FIG. 12 illustrates a modified bag 164 turned inside out with substantially the same basic construction as bag 10 but with eyelets 166 for receiving the loops 144 of cord on opposed sidewalls 26 of the bag. The eyelets 166 are formed by a strip 168 of fabric which is folded over on itself and secured together by a line of stitches 170 to form each eyelet. Preferably, each strip 168 is attached to a sidewall 26 by a flexible adhesive, stitches or heat seals. Each loop 144 is a separate cord 146 which is installed by passing it through an eyelet 162 on each sidewall 26 and through a central region 70 of each gusseted sidewall 28 at spaced apart points 66 & 68 so that it has segment 164' on the inside of the sidewall in the central region. To provide a closed loop, the cord is securely connected together, such as by a knot 74, adjacent its free ends. After the eyelets 166 and loops 144 of cord are installed, the bag is inverted so that they are inside the bag. When the bag is filled each loop 144 of cord has a diamond configuration with portions 148 extending obliquely between each pair of adjacent sidewalls. With this construction, there are no strips 168 of material over the gussest panel fold lines 58 and 60 which makes it easier to collapse and fold the bag. This construction also provides unobstructed outer faces of the sidewalls 26 which facilitates applying printed matter, artwork and the like thereon.

Figure 13:
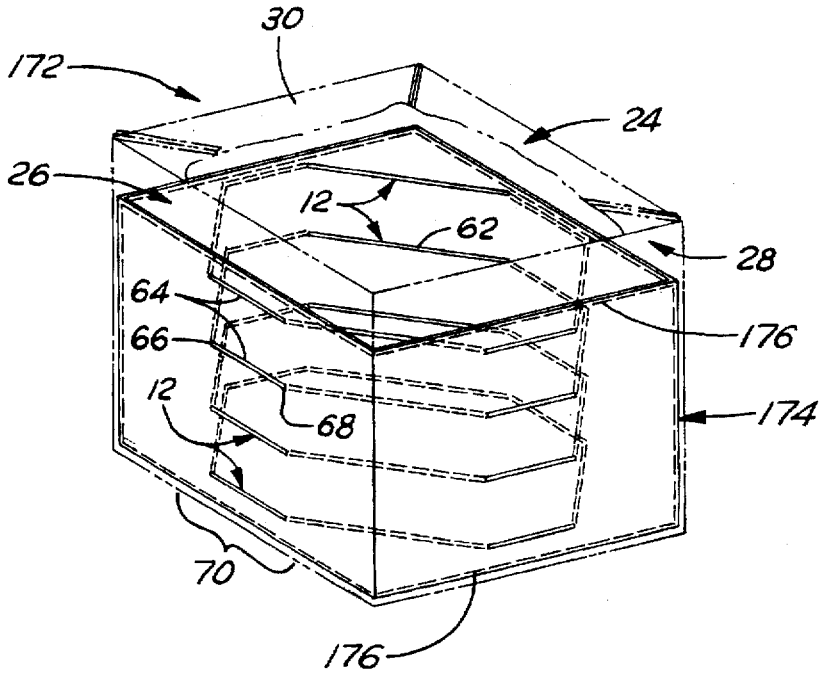
FIG. 13 is a perspective view of a modified bag embodying this invention with the loops of cord carried by a band disposed in the bag immediately adjacent its sidewalls.

FIG. 13 illustrates a modified bag assembly 172 embodying this invention in which all of the loops 12 of cord are completely inside the bag. Bag 172 has basically the same construction as bag 10 except that all of the loops 12 of cord are disposed interiorly of the bag in a carrier band 174 which, as shown in FIG. 13, is made as an open loop of a flexible fabric material having no top or bottom, and which is dimensioned to be received in the bag immediately adjacent the sidewalls 26 & 28 of the bag. This band may be referred to colloquially as a "bellyband". The band 174 extends around the inner periphery of the bag and is closely fitted with the sidewalls of the bag. Preferably, the band 174 and bag are of the same material. If they are of a woven fabric, preferably the band is attached to the bag, such as by an adhesive or stitches 176 which may extend around the bag adjacent the upper and lower edges of the band.

Preferably, before the carrier band 174 is placed in and secured to the bag, the loops 12 of cord are disposed in the band in substantially the same configuration and arrangement as that previously described for the bag of FIGS. 1 and 2 and hence will not be again described hereat. Alternatively, if desired loops 76, 90, 122 or 144 in the configuration and arrangement described in connection with the modifications of FIGS. 3–12 may be disposed in the band. Preferably, the band 174 also reinforces the sidewalls 26 & 28 of the bag.

Figure 14:
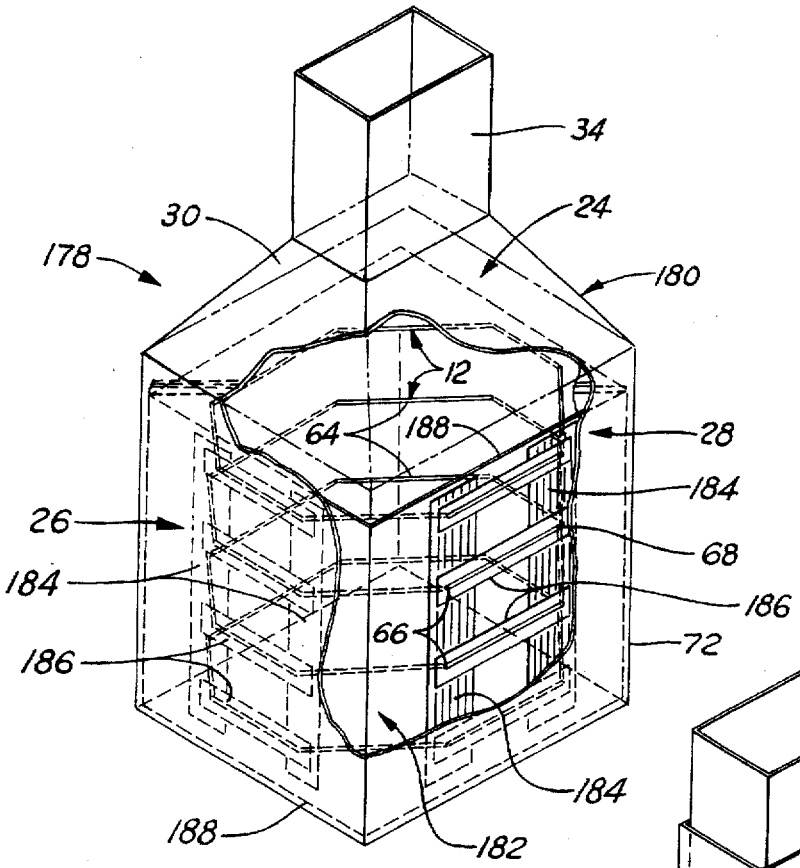
FIG. 14 is a perspective view of another modified liner bag embodying this invention with loops of cord carried by a band disposed in the liner bag.

FIG. 14 illustrates a liner bag assembly 178 with an outer bag 180 of a plastic film (preferably transparent) which has basically the same construction as the bag 10 and an inner carrier band 182 of a plastic film received in the outer bag immediately adjacent its sidewalls 26 and 28. The loops 12 of cord 14 are all carried by the inner band 182 with each loop having a portion 62 extending diagonally between each pair of adjacent sidewalls and a portion 64 passing at points 66 and 68 through the liner and extending along the outside thereof. Preferably, to reduce the tendency of the cord to cut or tear the band 182 when the bag 178 is filled, and particularly if dropped, strips of filament tape 184 are applied to the outside of the band over the locations 66 and 68 at which the cord passes through the band and tape. Preferably, the cords pass through each strip of tape 184 adjacent its outer side so that most of the width of tape underlies a cord portion 64 to thereby further minimize the tendency of the cord to cut the liner.

If desired, all the holes 66 & 68 can be sealed and the cords tacked to the sidewalls of the band 182 by strips of adhesive tape 186, such as a PVC tape. Taping the cords to the band prevents them from being discharged from the bag 178 in the event they are cut. Preferably, the carrier band 182 is secured to the liner bag such as by heat Seals. Preferably, the heat seals 188 extend circumferentially continuously around the bag adjacent the upper and preferably also the lower edges of the band.

Figure 15:
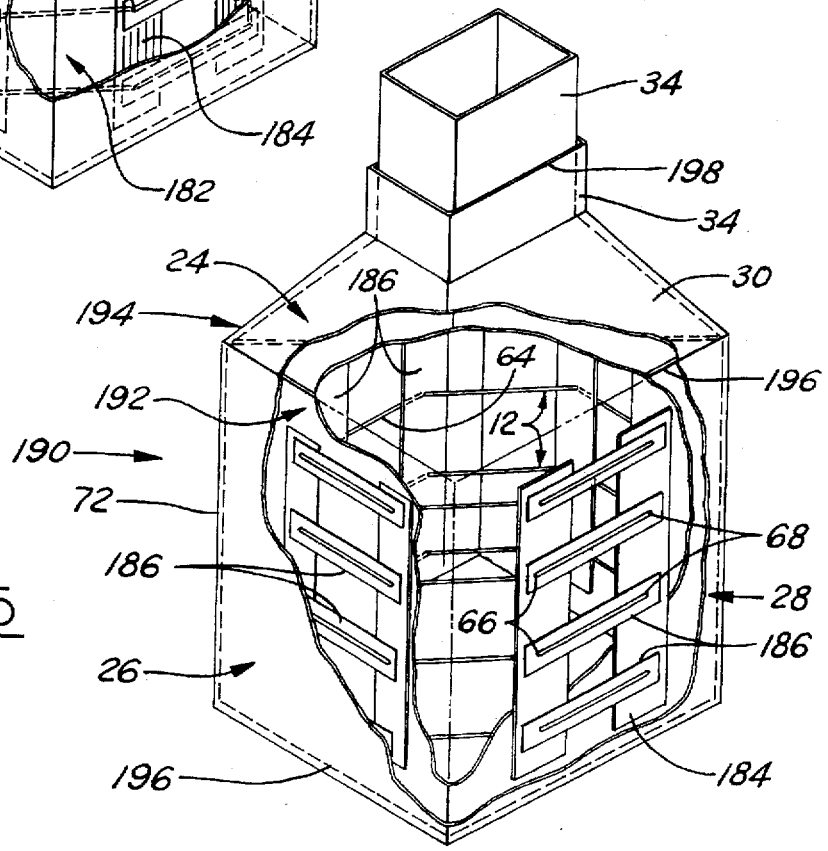
FIG. 15 is a perspective view of double liner bags embodying this invention with an inner liner bag with loops of restrainer cord received in an outer liner bag.

FIG. 15 illustrates a modified liner bag assembly 190 embodying this invention with an inner liner bag 192 received in a complementary outer liner bag 194. Both the inner and outer liner bags have the same basic construction as bag 10 and are made of a plastic film. The inner liner 192 has a plurality of loops 12 of cord 14 which are carried by the inner liner. Preferably, the points 64 and 68 at which the cords pass through the inner liner are reinforced by strips or pieces of filament tape 184 received on the outer face of the sidewalls of the liner. Preferably, the holes 66 & 68 through the liner are sealed by strips 186 of PVC tape which also retain the cords.

After the cords are installed in the inner liner bag 192, it is disposed complementarily in the outer liner bag 194 and then preferably connected to the outer liner bag by heat seals 196 extending around the sidewalls adjacent the bottom and top of the liner bag assembly 190 and preferably a heat seal 198 extending around the periphery of the spouts. The assembly 190 provides a leak-proof liner bag suitable for retaining a wide variety of liquids. In manufacturing the liner assembly, it is usually easier to completely fabricate the inner liner bag 192, install the loops of cord therein, and then collapse and fold the inner liner bag preferably into the configuration of FIG. 18. Thereafter, the outer liner bag can be fabricated over the collapsed and folded inner liner bag and attached to it by heat seals. However, it is also possible to completely fabricate both the inner and the outer liner bags and then insert the inner liner into the outer liner, inflate the inner liner to complementary engage it with the outer liner, deflate the inner liner, collapse and fold together both of them, and thereafter attach them together by heat seals.

For some applications of the double liner bag assembly 190, the inner bag 192 can be fabricated without any bottom and the outer bag 194 fabricated without any tog and spout. The sidewalls of the inner bag are inserted into and overlap with the sidewalls of the outer bag and the sidewalls of both bags are sealed together circumferentially continuously adjacent at least the upper end of the sidewalls of the outer bag to produce a modified bag assembly 190 with double thickness sidewall portions and single thickness end wall portions.

Preferably, a typical bag embodying this invention when filled will be substantially cubical with substantially square ends 22 & 24 and square or rectangular sidewalls 26 & 28 each having a length along one edge of about 42 inches. Preferably, for bearing the weight of its contents, the bags will be made from a woven polypropylene fabric having a nominal weight of about 6¼ ounces per square yard and a tensile strength of about 280 to 315 pounds for a strip of fabric having a nominal transverse width of 1" in its normal unloaded state. Preferably, the cord 14, 78 & 92 of the loops has a comparable tensile strength, is flexible and preferably does not stretch substantially under load. A cord of Kevlar® fibers with a nominal diameter of about 0.050" and a nominal tensile of 315 pounds has been found to be highly satisfactory. It has been empirically determined that if the tensile strength of the cord forming the loops is sufficiently greater than the tensile strength of the fabric of the bag, then when the filled bag is dropped upon impact the loops of cord cut or tear the fabric. For example, bags with these nominal dimensions made of a polypropylene fabric with a nominal weight of 6¼ ounces per square yard with loops 12 of cord 14 made of Kevlar® with a nominal diameter of 0.070" and tensile strength of 450 pounds, when dropped from a height of 6 feet above a concrete floor upon impact the loops of cord cut the fabric of the bags. However, when the same bags having the same arrangement of loops of a cord of Kevlar® with a nominal diameter of 0.050" and tensile strength of 315 pounds were subjected to the same test, there was substantially no cutting or tearing by the cords of the polypropylene fabric of the bags.

A typical liner bag may have substantially the same dimensions and be made of a plastic filament such as polypropylene or polyethylene having a nominal thickness of about 0.002 to 0.020 of an inch and preferably 0.003 to 0.004 of an inch. A cord of Kevlar® fibers with a nominal diameter of 0.050 and a nominal tensile strength of 315 pounds has been found to be highly satisfactory. Preferably, the points where the cord passes through the bag are reinforced by a filament reinforced tape 184, such as a strip of 3M filament tape with reinforcing fibers of fiber glass. For some applications, such as shipping foodstuffs, the plastic film and cord must be made of an FDA approved material, such as polyethylene or Nylon film and cord for shipping powdered cheese or spices. Where a completely leak-proof container must be provided, a liner bag 178 or 190 may be utilized typically in conjunction with a woven fabric outer bag to provide the necessary strength for supporting and carrying the contents of the liner bag.

Figure 16:
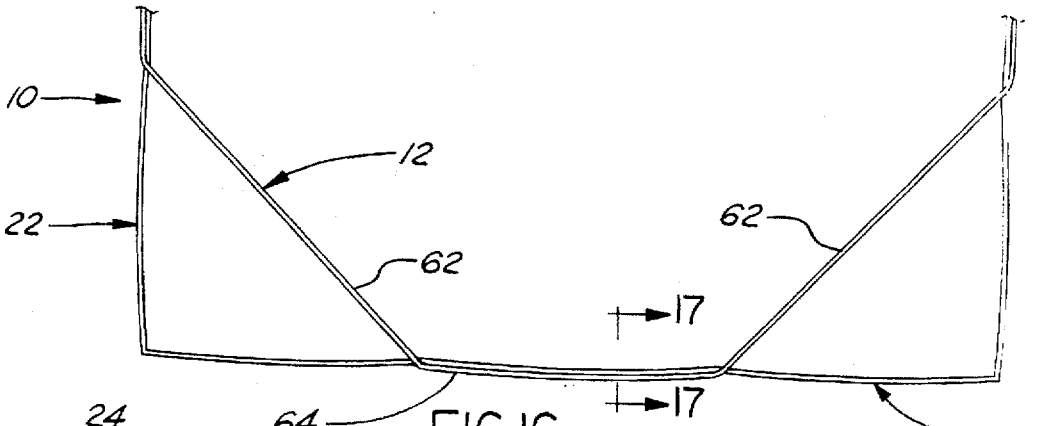
FIG. 16 is a fragmentary horizontal sectional view showing a loop of cord and sidewalls of the bag of FIG. 2 as expanded and filled.
Figure 17:
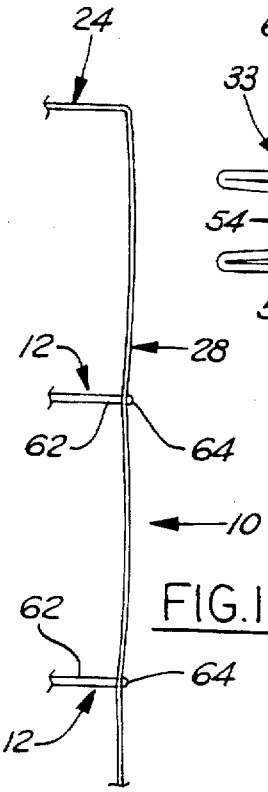
FIG. 17 is a fragmentary vertical sectional view taken on line 17—17 of FIG. 16 and showing a sidewall and adjacent loops of cord of the bag of FIG. 2 when the bag is expanded and filled.

Preferably, just before filling each bag it is first expanded to substantially the cubical configuration its walls will assume when it is filled, such as by directing a moving stream of air into the bag through its spout. This may be accomplished by utilizing a hand-held leaf blower, preferably powered by an electric motor, or other fan or blower with an outlet which can be readily inserted into the spout of the bag. After the bag has been expanded, the bottom of the bag is placed on a supporting surface and it is filled by inserting into the spout 34 a nozzle or chute discharging granular or liquid material into the bag. While the bag is being filled, the material flows around the cords therein and bears on the sidewalls which are restrained and retarded from substantially bowing and bulging outwardly by the loops of cord which are tensioned by the material bearing on the sidewalls of the bag. As shown in FIGS. 16 and 17, when the bag is completely filled all of the loops of cord are in tension and there is relatively little bowing and bulging of the sidewalls of the bag, each of which remains substantially planar. After being filled, the spout is closed, such as by looping a cord around it and securely tying the cord. If desired, the tied off spout can be tucked into the top of the bag.

For some applications, the bag can be inserted into a rigid outer container 16 (FIG. 1) either before or after filling and preferably before filling. Typically, a rigid cover is placed over and secured to the container.

The filled fabric bag can be lifted and carried by its straps 38. A plurality of bags can be stacked side-by-side so that their adjacent sidewalls bear on one another and the filled bags can also be stacked one on top of another several layers high typically up to four layers for a stack with a total height of about 14 feet. When stacked with their sidewalls and end walls abutting there is relatively little void area or space between adjacent bags and hence minimal waste space in storage of bagged material. Compared to prior art bags without restrainers, the bags of this invention improve storage efficiency or utilization of a given storage area or volume by about 9% which substantially decreases material bagging, packaging, shipping, storage and handling costs.

The loops 12 of cord may be formed in a bag 10 as shown in FIG. 2, by a method illustrated generally in FIG. 18. First, the bag may be completely fabricated and then folded to a generally flat configuration as shown in FIG. 18 with its gusset panels 54 & 56 lying between and generally parallel to its flat panels 50 and 52. Each loop 12 is formed by passing a needle 202 threaded with a cord 14 completely through all of the panels (50, 56 & 52) to one side of the folded bag and then through all of the panels (50, 54 & 52) to the other side of the folded bag so that the cord passes through all panels of the bag. Thereafter, to form a closed loop, the free ends of the cord are securely connected together such as by tying them in a knot 74. Preferably the desired length of the closed loop is predetermined and the cord is premarked at points 204 spaced apart thereon at this length so that when the cord is tied with the marked points 204 aligned or overlapping, the loop will have the desired predetermined length. Preferably, the needle and cord pass through the panels of the folded bag at locations 206 and 208 each spaced inwardly from an adjacent side edge 72 a distance equal to about ⅓ of the width of the panels 50 & 52 which is equal to the width of the sidewall 26 of the bag when it is expanded and filled.

To complete the bag, the desired number of loops 12 of cord are installed in the folded bag at longitudinally spaced apart locations. Typically, each bag will have three to six, and usually about four, loops which may be substantially equally spaced apart verticaly along the height of the expanded and filled bag. For example, if a bag will have four loops 12 and each sidewall of the bag will have a vertical height of about 42", the loop adjacent the bottom wall of the bag is typically spaced about 9" above the bottom and the loops are spaced about 8" apart. It has been empirically determined that if bags with a nomimal vertical height of 42" inches are dropped when filled they tend to burst in an area about 8" to 10" above the bottom wall of the bag. Therefore, placing one of the loops in this area also tends to reinforce the sidewalls of the bag and decrease its tendency to burst when dropped.

This method may also be used to install the loops 12 of cord in the carrier bands 174 and 182 of the bags of FIGS. 13 and 14 by folding the band into a generally flat configuration with pairs of gusseted sidewall panels received between a pair of flat overlapped sidewall panels. The loops 12 are installed in the band before the band is disposed in and attached to the bag.

Figure 19:
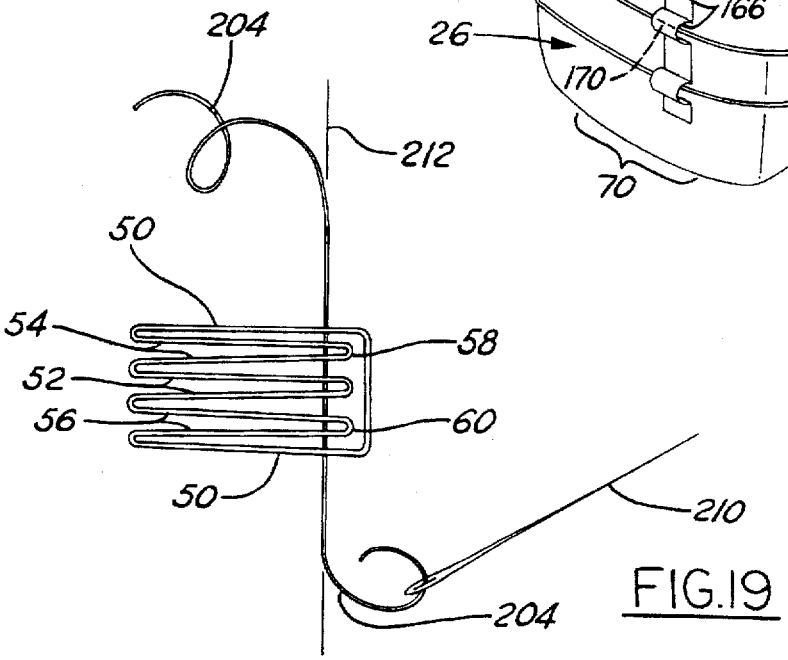
FIG. 19 is an end view of a folded bag illustrating use of a needle threaded with a cord to form a loop of the bag of FIG. 2.

As shown in FIG. 19, if desired, the loops 12 of the cord 14 may be formed in the bag with a single pass of a needle by further folding the bag in the configuration of FIG. 18 about its longitudinal axis adjacent the gusset fold lines 58 and 60 so that the side panels 26 are folded in half and all of the gusset panels overlie one another. In this configuration (FIG. 10), a loop 12 may be formed by passing a needle 210 and cord 14 once through all of the folded panels and then to form a closed loop the cord is connected together, such as by tying a knot 74 adjacent its free ends. Preferably, the desired length of the closed loop Is predetermined and the cord is marked at points 204, so that when the cord is tied at these points, the closed loop will have the desired predetermined length. Preferably, the needle 210 passes through all of the panels at a point 212 spaced inwardly from the side edge adjacent the fold lines 58 and 60 a distance equal to about ¼th to ⅙th of the width of a sidewall 28 of the bag when it is expanded and filled.

Figure 21:
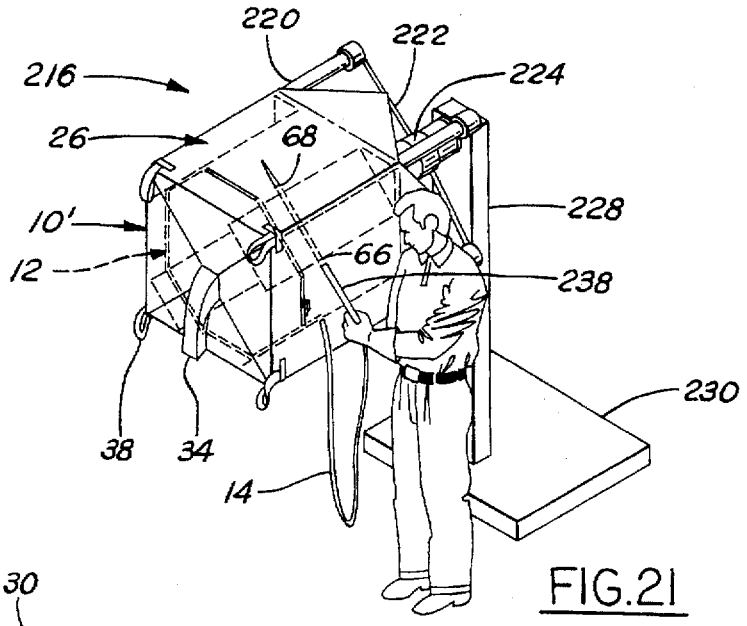
FIG. 21 is a perspective view of the fixture with the bag received thereon in which a needle threaded with a cord is being inserted through the bag to form a loop of cord.
Figure 20:
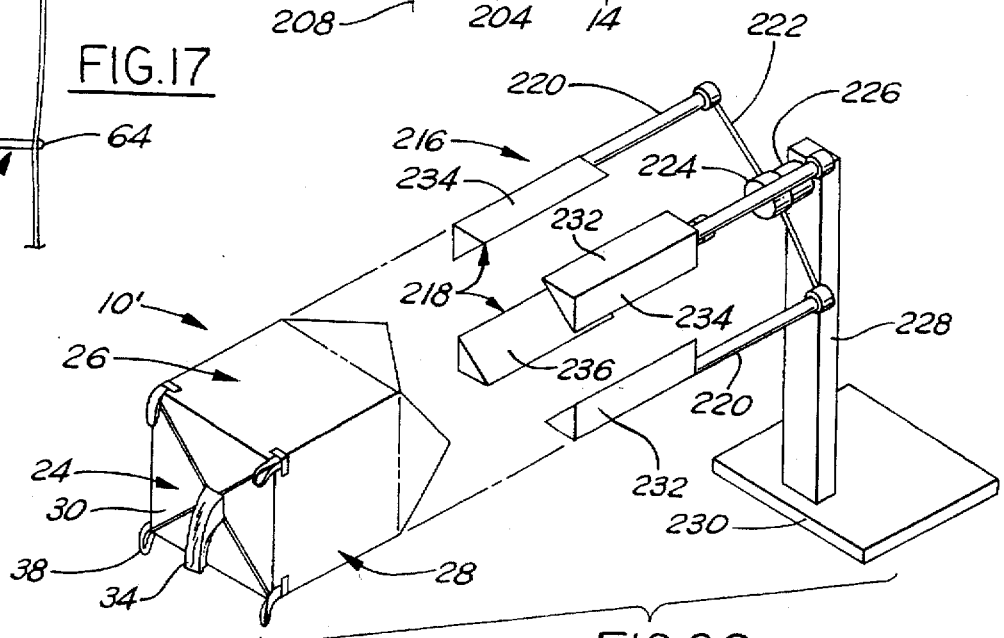
FIG. 20 is a perspective view of a fixture for receiving a partially fabricated bag with an open end for installing loops of cord in the bag.

Another method and a fixture 216 for forming the loops of cord in a bag is illustrated in FIGS. 20 and 21. As shown in FIG. 20, the bag 10 is only partially fabricated so that it has at least one completely open end which is preferably the bottom end 22 and disposed on the fixture. The fixture has four spaced apart carriers 218 over which the open ended bag is slidably received to dispose each sidewall 26 & 28 of the bag in a taut generally planar condition and at generally right angles to its adjacent sidewalls. Each carrier 218 is received on an arm 220 supported by a spoke 222 attached to a hub 224. For indexing the bag, the hub is journalled for rotation about a generally horizontal axis by a bearing assembly 226 mounted on an upright support post 228 fixed to a base 230 of the fixture.

Preferably, each carrier 218 is generally triangular in cross section and has two flat panels 232 & 234 at substantially a right angle to each other for bearing on a portion of adjacent sidewalls adjacent the corners of the bag. For guiding a needle used to install cords in the bag, preferably each carrier also has a flat panel 236 obliquely inclined to the side panels, preferably at an acute included angle of substantially 45°. To facilitate locating the point at which the needle is spaced from an edge or corner of the bag when it passes through a sidewall, preferably the transverse width of each panel 232 & 234 of the carrier is substantially equal to the desired distance the cord will be spaced from the side edge or corner 72 of the bag at the point where it passes through an adjacent side of the bag. Typically, the transverse width of each panel is equal to about ¼ to ½ and preferably about ⅓ of the nominal width of each sidewall of the bag.

In using the fixture 216, as shown in FIG. 21, the open ended bag 10' is telescoped over and slidably received on the carriers 218 with each carrier disposed in one of the corners 72 of the expanded bag. A loop 12 is formed in the bag by passing a long needle 238 threaded with a cord 14 through both sidewalls 26 & 28 at points 66 & 68 immediately adjacent the longitudinal edges of the oblique panel 236 of each carrier so that the needle slides over and is guided by the oblique panel of each carrier. Preferably, the needle 238 is longer than the width of the panel 236. After a worker passes the needle and cord through one pair of adjacent sidewalls 26 & 28, preferably the carriers and hub are indexed ¼ of a revolution to position an immediately succeeding carrier adjacent the worker for passing the needle and thread through the next pair of adjacent sidewall. After the cord has been passed through all four pairs of adjacent sidewall portions, to form a closed loop the free ends of the cord are securely connected together by tying a knot 74. The length of each loop can be adjusted and determined for each bag by manually slightly tensioning the cord so that it is taut immediately before and while tying the knot therein. After the desired number of loops have been placed in the open bag, it is slidably removed from the fixture. Thereafter, the open end is closed and completed to form the bottom end 22 of the bag, such as by stitching together with a thread the adjacent edges of the adjacent triangular portions 30 of the bag.

Figure 22:
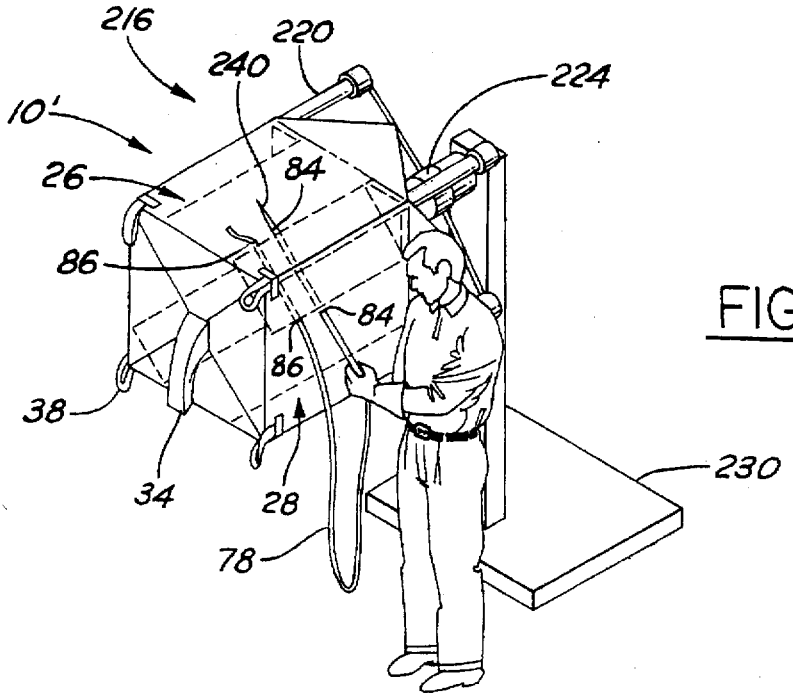
FIG. 22 is a perspective view of the fixture with a bag received thereon in which a needle threaded with a cord is being inserted to form a modified configuration of a loop of cord.

The fixture 216 may also be used to install the loops 76 of cord in the configuration shown in FIGS. 3 and 4. To do so, a partially completed bag with at least one open end is telescoped over the carriers 218 of the fixture. As shown in FIG. 22, a needle 240 threaded with a cord 78 is passed at first points 86 through both sidewalls of one of the pairs of adjacent sidewalls 26 & 28 by a worker utilizing the oblique panel 236 of one of the carriers to guide the needle. The needle and thread are then again passed through the same pair of sidewalls at second points 84 longitudinally spaced from the first points 86 and thereafter the free ends of the cord are slightly tensioned so the cord is taut and securely connected together by tying a knot 74 to provide a closed loop 76 of the desired length. This procedure is repeated to provide the number of loops 76 desired in this pair of adjacent sidewalls (such as the three loops of FIG. 4). Thereafter, the fixture 216 is indexed to dispose an immediately succeeding carrier 218 adjacent the worker who threads the needle with pieces of cord and utilizes it to install the desired number of loops in this pair of sidewalls. Thereafter, the fixture is indexed and loops are installed in the remaining pairs of adjacent sidewall portions to complete the installation of the desired number of loops in all four pairs of adjacent sidewalls of the bag. After installation of the loops 76 is completed, the bag is removed from the fixture and the open end of the bag is closed and completed by stitching together the adjacent edges of the triangular portions 30 of the bottom end wall.

In a similar manner, the fixture 216 may be utilized to install the loops 90 of cord in a bag in the configuration shown in FIG. 5. When the loops are inserted in the configuration of FIG. 5, all of the loops in a pair of adjacent sidewalls are formed with a single piece of cord 92. The needle is passed through the pair of bag sidewalls at longitudinally spaced apart points to form all of the loops in the pair of sidewalls and then the free ends of the cord are tensioned and tied together in a secure knot. To form the three loop pattern of FIG. 5, the needle and cord are passed through the pair of bag sidewalls six times at six laterally spaced apart sets of points (98 & 100, 102 & 104, 106 & 108,110 & 112, 114 & 116, and 118 & 120). Preferably the intermediate sets of points (102 & 118, 104 & 120, 108 & 116, 106 & 114) are substantially coincident or overlapped even though the sequence in which the portions of the cord are installed in the bag is such that as the cord is being installed, each set of points through which the needle is inserted is spaced from the immediately preceding set of points. For example, as shown in FIG. 5, the needle and thread can be passed through one pair of adjacent sidewalls in the sequence of the points 98 through 120 or the reverse thereof.

After the loops 90 are completely installed in all four pairs of adjacent sidewalls, the bag is removed from the fixture 216 and the bag end wall 22 completed by stitching together the adjacent edges of all four triangular portions 30.

The fixture 216 also may be utilized to install the loops of cord through the pleats or eyelets of the bags of FIGS. 8 through 12. To do so, a partially fabricated bag with pleats and at least one open end is telescoped over the carriers 218 of the fixture. To form a loop, a needle threaded with a cord is passed through a pleat on each of the sidewalls seratum with the fixture being indexed to dispose the pleats of each immediately succeeding sidewall adjacent a worker who passes the threaded needle through the pleat. After a loop of cord is passed through the pleats on all four sidewalls, it is securely connected together to provide a closed loop, such as by tying knot 74 adjacent its free ends. Preferably, each of these cords is premarked so that when the knot is tied at the marks, the loop will be of a desired predetermined length. After all of the loops are installed, the bag is removed from the fixture, inverted or turned right side out so that the loops of cord and pleats are disposed inside the bag, then the open end of the bag is completed, such as by stitching together the adjacent edges of the triangular portions 30 of the end wall and installing any necessary spout.

So that the cord can be tied into a closed loop of a predetermined desired length, when the partially fabricated bag is received on the carriers 218 of the fixture, the sidewall panels of the bag are slack or not taut. Thus, the partially fabricated bag is loosely received on the carriers preferably with the pleat or eyelet associated with each sidewall overlying or immediately adjacent one of the carriers.

If desired, the transverse spacing between the carriers can be adjusted so that when a cord encircles all the carriers and is tensioned or drawn tight, its perimeter is equal to the desired predetermined length so that it can be simply tensioned and tied securely together to provide a closed loop of the desired predetermined length. This eliminates the need to premark each cord and to manipulate and tie it so that the marks overlap to produce a loop of the desired predetermined length.

Figure 23:
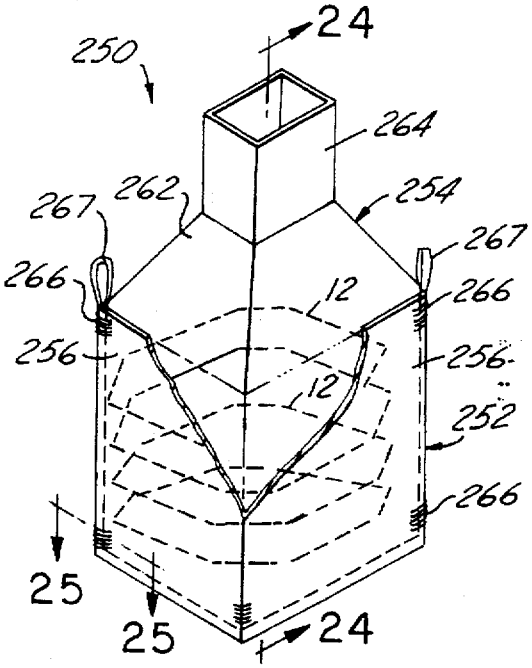
FIG. 23 is a perspective view of yet another embodiment of the bulk bag of the invention.
Figure 24:
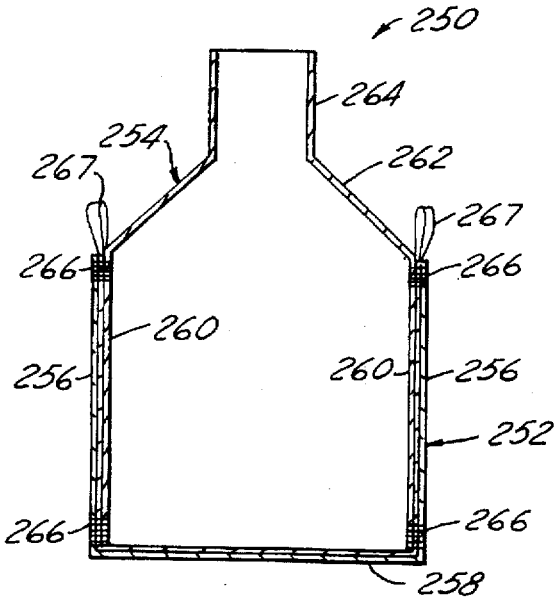
FIG. 24 is a vertical sectional view taken along line 24—24 of FIG. 23.
Figure 25:
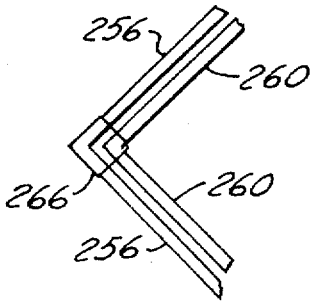
FIG. 25 is a fragmentary horizontal sectional view taken along line 25—25 of FIG. 23.

FIGS. 23–25 illustrate a modified bag construction in which the bag 250 is made up of an outer bottom bag 252 and an inner top bag or liner 254. The outer bottom bag has four sidewalls 256 and a bottom wall 258 with an open top. The inner bag has four sidewalls 260 and a top wall 262 with a tubular spout 264 and an open bottom. To assemble bag 250, the sidewalls of the inner top bag 254 are inserted into matching relation to the sidewalls of the outer bottom bag 252. The sidewalls 256 of the outer bag are then secured to at least the upper corners of the sidewalls 260 of the inner bag but preferably at each upper and lower corner by stitches 266. This construction essentially forms a double sided bag. Preferably, the outer bag is made of heavier material than the inner bag which reduces the total weight of the bag. For example, the outer bag may have a nominal weight of six ounces per square yard, while the inner bag may be of a fabric having a weight of three ounces per square yard. The heavier outer bag construction allows lifting straps 267 to be tacked or stitched thereon and is strong enough to withstand lifting the bag when filled. This construction provides a double sided bag having a reduced weight and requires less quantity of material for construction yet maintains strength to carry the contents of the bag when loaded.

An additional advantage to this construction is that the loops of cord 12 can be attached and secured to the sidewalls 260 of the inner bag before the inner bag is inserted into the outer bag. This construction allows the loops of cord 12 to be disposed entirely within the bag 250 with no portions extending through the outer bag 252. This prevents the outer bag from having to be formed with holes for the cord loops 12. Additionally, forming the cord loops 12 on the inner bag before it is inserted into the outer bag enables easier assembly of the loops because the final assembled bag would not have to be turned inside out in order to form the cord loops on the inner bag wall. Also, the open top configuration of outer bag 252 allows easy access for attaching the lifting straps 267 to the top of the outer bag without interference from the top 262 and spout 264 of the inner bag 254.

Figure 26:
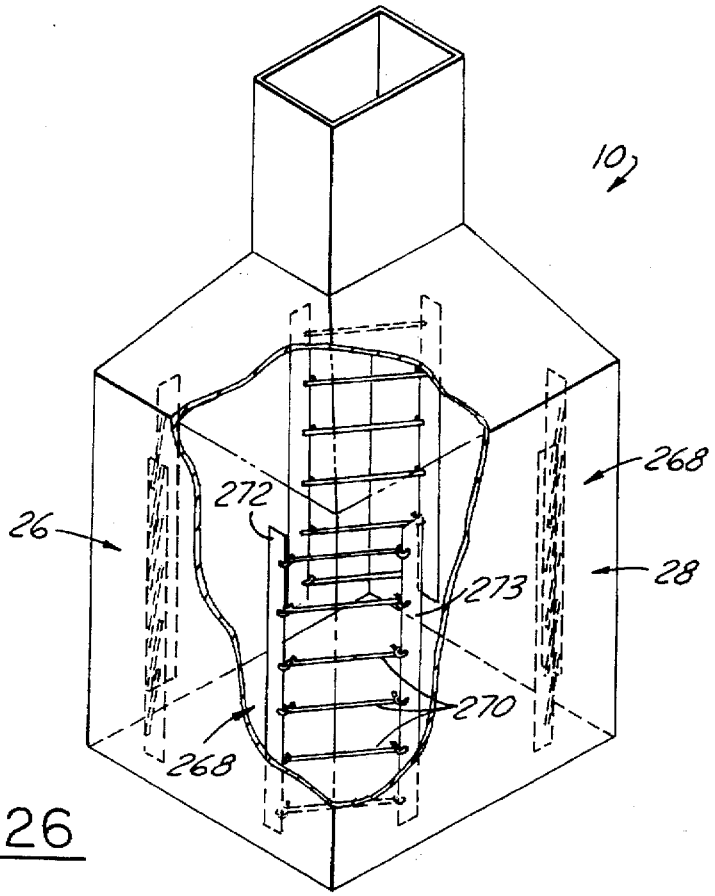
FIG. 26 is a perspective view of yet another embodiment of the present invention.

FIG. 26 illustrates another modified bag formed with a modified cord webbing 268 at each corner. The bag has substantially the same basic construction and arrangement as the bag 10 of FIG. 2. However, one problem that arises with the bag shown in FIG. 2 is that the contents therein tend to catch and pull the portions 62 of the loops. This tends to increase the size of the openings 66, 68 in the central regions 70 through which the loops extend. Thus, the stress-enlarged openings may allow the contents of the bag to leak. This problem, however, is overcome by the cord webbing 268. Each web 268 is formed from a plurality of cord sections 270, each having their opposite ends respectively tied to strips 272 and 273 of stitched fabric and secured thereto by knots 274. Thus, the pair of elongated strips 272 of fabric are arranged parallel to one another with cord sections 270 extending transversely therebetween at equally spaced locations along the length of the strips. Four sets of strips 272 and 273 are then attached one to each of adjacent sidewalls 26 and 28 by a flexible adhesive, stitches or heat seals. The cord sections 270 then extend obliquely between each pair of adjacent sidewalls 26,28 to provide a flexible, collapsible corner tension gusset structure in each of the four corners of the bag to thereby restrain bowing and bulging of the sidewalls by the contents of the bag. Since the cords do not extend outside the bag, there are no openings from which the contents of the bag can leak.

Figure 27:
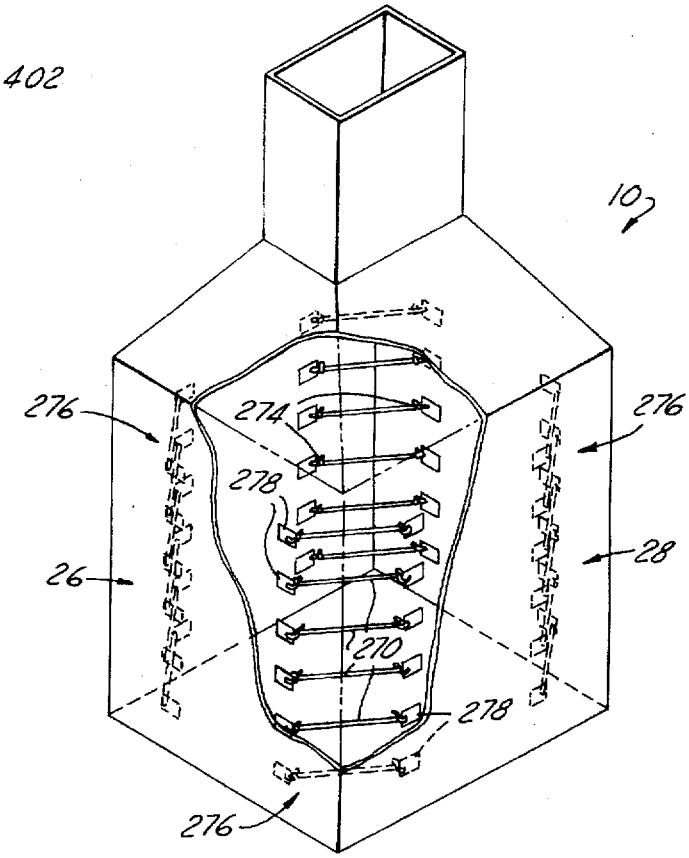
FIG. 27 is a perspective view of still another embodiment of the bulk bag of the present invention.

FIG. 27 illustrates a bag 10 similar to the bag shown in FIG. 26 with a modified four-corner gusset webbing 276. In order to reduce the amount of material to secure the cord sections 270, the opposite free ends of each cord section 270 are secured to tabs 278 of woven material and secured thereto by knots 274. The tabs are then secured to the sidewalls of the bag in the same manner previously disclosed with reference to FIG. 26. The tabs 278 of each gusset webbing set 276 are located on adjacent bag sidewalls 26,28 at evenly spaced increments in a vertical row so that when the bag is filled, the cord sections 270 and gusset set 276 extend transversely between their associated adjacent sidewalls 26,28 of the bag.

Of course, it will be understood that the bags in FIGS. 26 and 27 are shown having the same unitary construction as the bag of FIG. 2. However, the cord webbing gusset sets 268 and 276 shown in these figures are equally applicable to other forms of the bag including bags formed with liners, liner bands and the double walled bag shown in FIGS. 23 through 25.

It is also to be understood that carrier band 174 may also be provided with the cord webbing gusset sets 276 and used to reinforce the inner liner 254 of the double walled bag 250. Preferably, when so used, band 174 is secured near the top of the liner sidewall 260 with an adhesive or double sided tape. The bottom of band 174 is secured to the bottom of the liner sidewall 260 about a distance upwardly from the bottom of wall 260, for example, about one inch, and secured by the adhesive or tape. However, it is preferable to thus secure the band at the bottom to the liner not in a Continuous bead, but rather by strips of tape placed at spaced locations to provide gaps therebetween so that any sifting of product out through the cord holes in band 176 and ending up between the band and the liner will drain through the gaps back into the liner. This prevents the product from becoming trapped between the band and the liner.

If the carrier band 174 is used with a fabric bag, it can be sewn to the bag at the top edge and secured at the bottom edge either by glue, tape or sewing, or other desired securement. Preferably, the bottom edge is secured to the bag at the four bottom corners and at the center of each bag wall to allow drainage of any product caught between the band and bag as discussed above.

Figure 28:
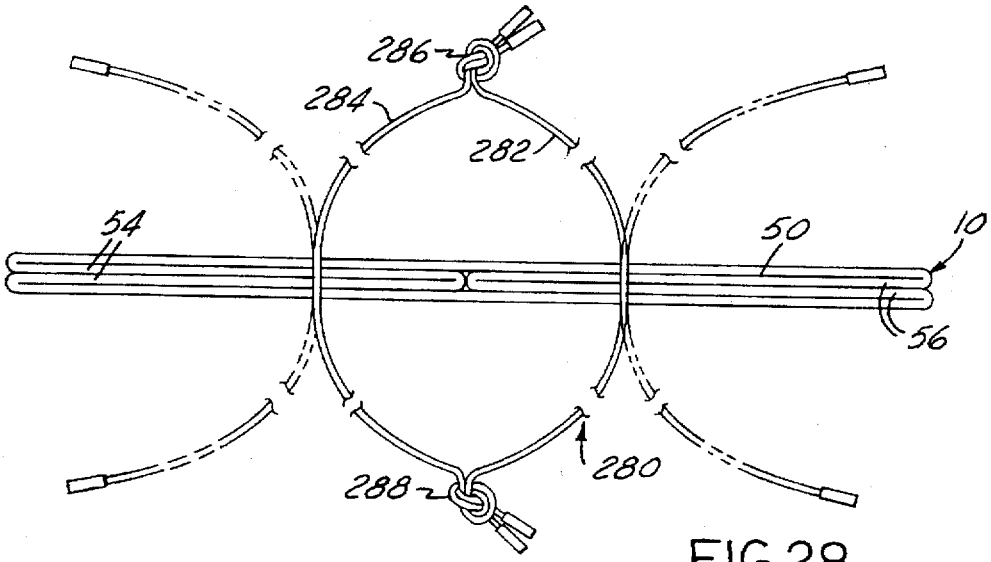
FIG. 28 is a side elevational view of a folded bag illustrating a double knot loop system of the invention.
Figure 29:
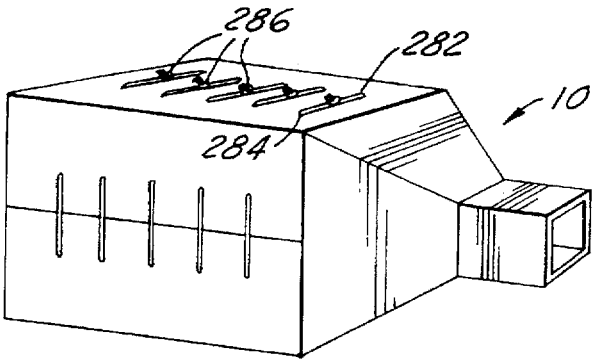
FIG. 29 is a perspective view showing the double knot loop system as made in FIG. 28 in an expanded bag.
Figure 34:
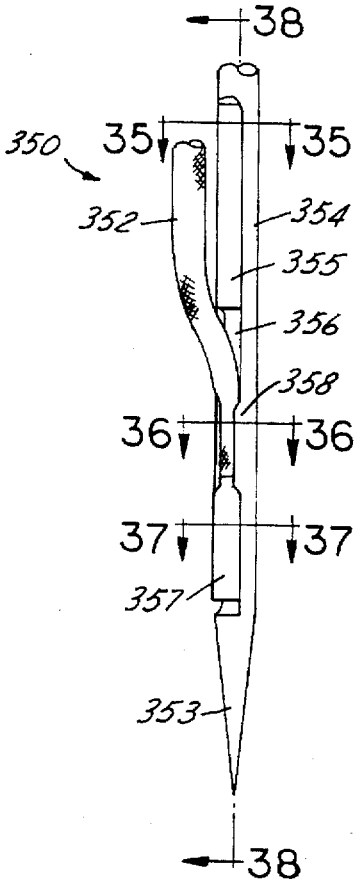
FIG. 34 is a fragmentary enlarged view of a loaded needle.
Figure 35:
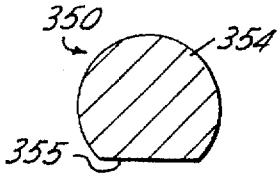
FIG. 35 is a horizontal sectional view taken along line 35—35 of FIG. 34.
Figure 36:
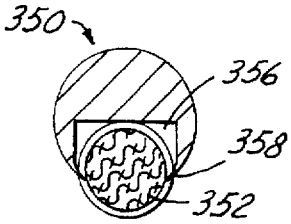
FIG. 36 is a horizontal sectional view taken along line 36—36 of FIG. 34.
Figure 37:
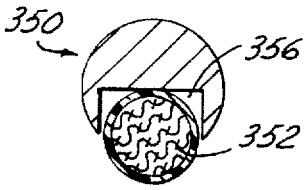
FIG. 37 is a horizontal sectional view taken along line 37—37 of FIG. 34.
Figure 38:
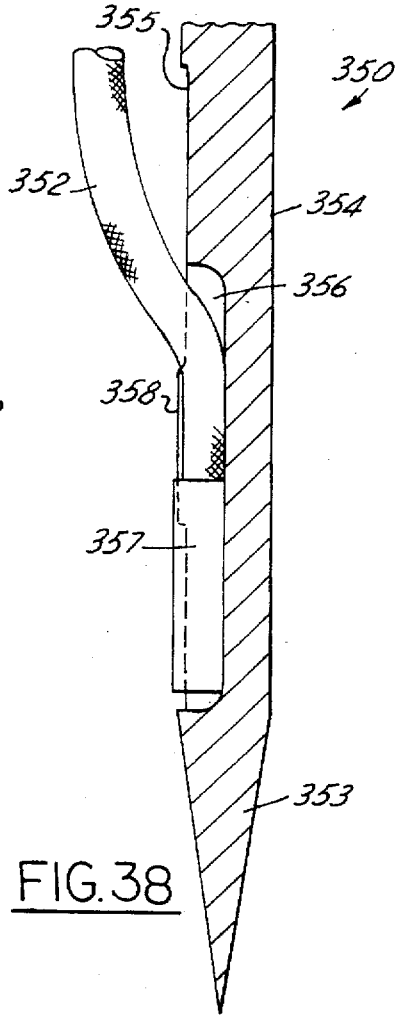
FIG. 38 is a vertical sectional view taken along line 38—38 of FIG. 34.

FIGS. 28 and 29 illustrate a faster and easier method of forming a loop on the bag 10 than the single knot loop system of FIG. 2. In this modification, each loop 280 is formed by two equal length sections 282 and 284 of a cord. In this embodiment, the bag may be fabricated and then folded to a generally flat condition as shown in FIG. 28 with its gusset panels 56,58 lying between and generally parallel to its flat panels 50,52. Cord sections 282 and 284 are then inserted through the folded bag an equally spaced distance from the center of the bag and with the cord section midpoints registered in the bag. The free ends of each cord section 282 are then tied to the respectively adjacent free ends of cord sections 284 to form a cord loop with two end knots 286,288, with one knot being on one exterior side of the folded bag and the other knot on the opposite exterior side of the bag. FIG. 29 illustrates the bag of this embodiment shown in an expanded condition.

One advantage of using two cords for each level of loop with knots on opposite sides of the bags (i.e., double knot loops) is that this double knotting prevents the tie cord from falling either into or off of the bag in the event that it breaks, i.e., a break anywhere in a given double knot loop leaves a knot on each side of a bag wall or walls to resist complete pull-through in either direction of the loop cord. This prevents product contamination and leakage.

Figure 30:
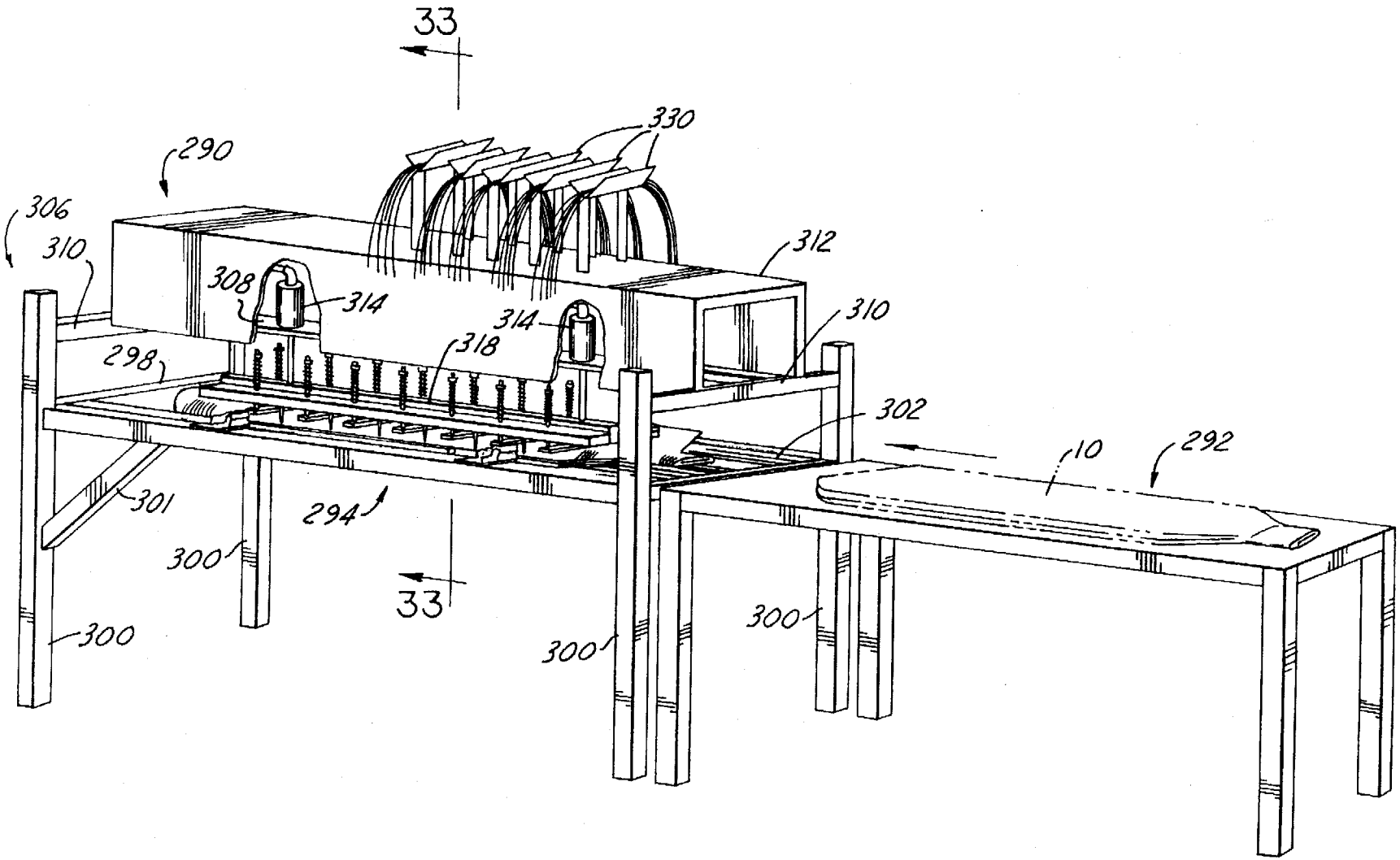
FIG. 30 is a perspective view of a stitching apparatus of the invention utilized in forming a plurality of double knot loops.
Figure 31:
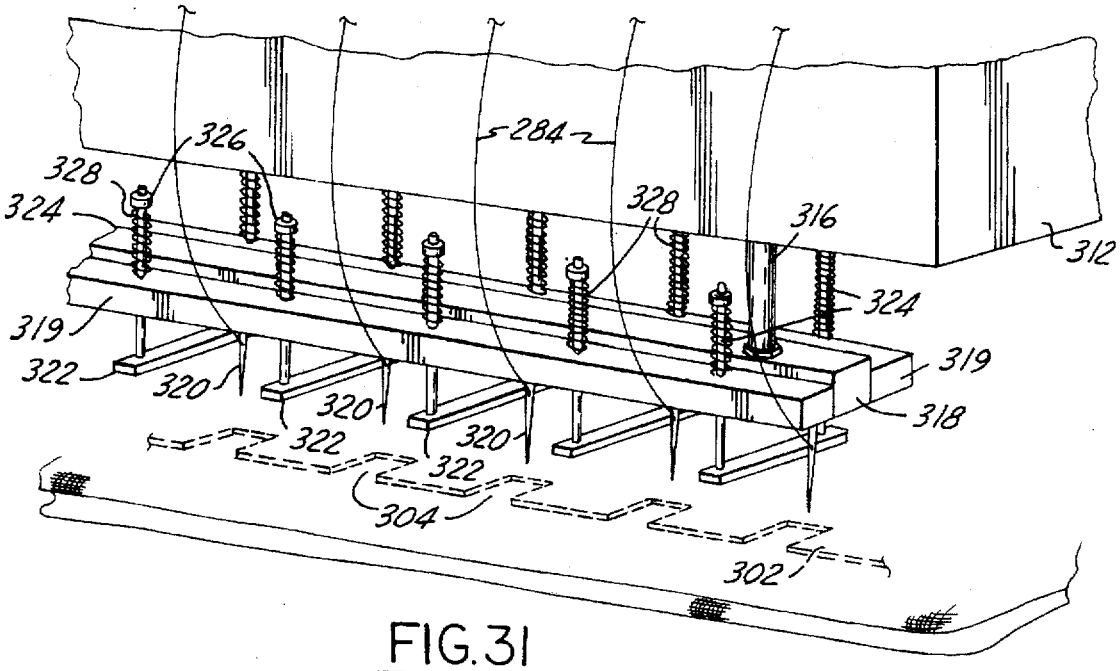
FIG. 31 is a fragmentary enlarged view of a portion of the stitching machine of FIG. 30 showing the cord-loaded needles at the beginning of their bag-penetrating downstroke.
Figure 32:
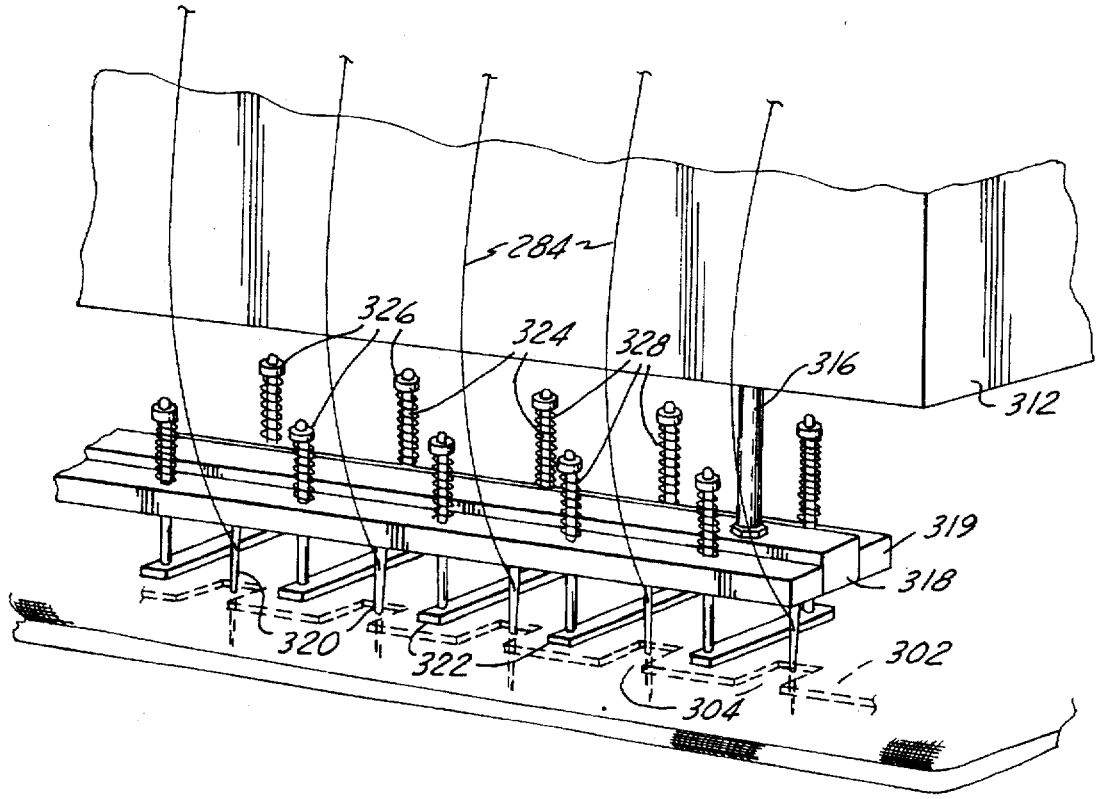
FIG. 32 is a view similar to FIG. 31 showing the needles being withdrawn from the bag and with needle ends of the cords being stripped from their associated needles.
Figure 33:
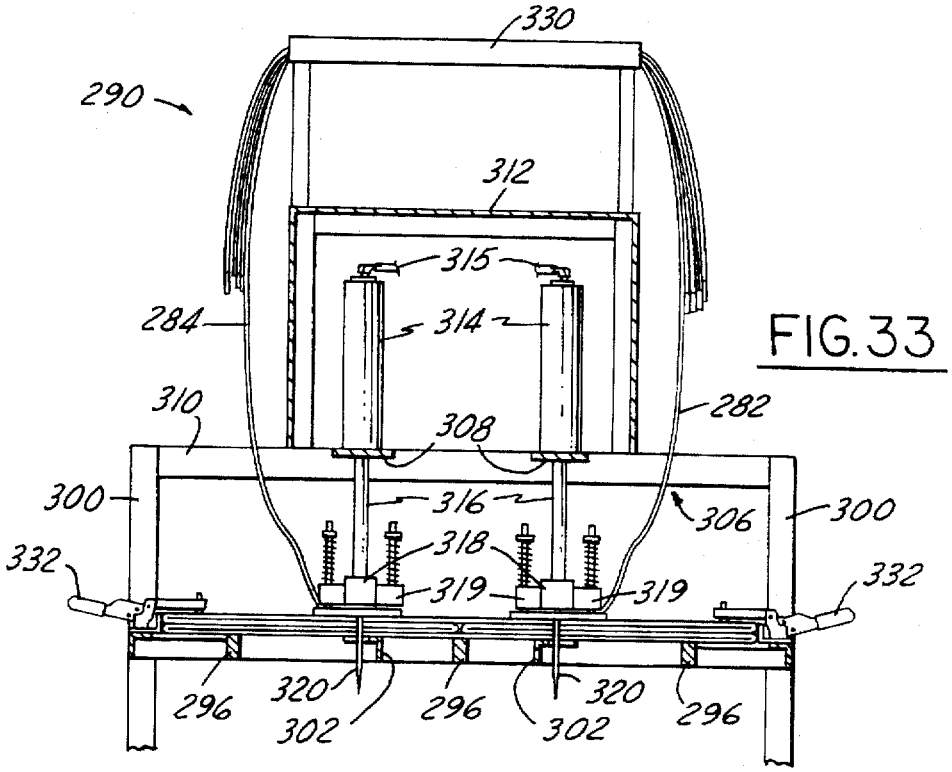
FIG. 33 is an end view of the stitching mechanism of FIG. 30 illustrated at the completion of the fabric-needle penetration downstroke.

FIG 30 through 33 illustrate a machine of the invention used for forming the double knot loop of FIGS. 28 and 29 for each bag. As seen in FIG. 30, the apparatus comprises a stitching machine 290 and an assembly table 292 which is shown separate from the stitching machine but could be formed as a unitary part thereof. The stitching machine comprises an open frame 294 and a plurality of evenly spaced rails 296 supported at each end by cross rails 298 and supported by legs 300. Braces 301 provide additional support. Within the open frame a pair of angle irons 302 are supported to extend longitudinally therein. Each angle iron 302 has notches 304 cut from one longitudinal edge thereof for the passage individually of the needles.

The legs also support an upper frame 306 composed of rails 308 supported at each end by cross bars 310. An open channel member 312 is supported at each end on the cross bars 310 to form a partially enclosed housing for the stitching mechanism. A plurality of pneumatic cylinders 314 are supported on the rails 308 and enclosed by the housing and are connected to a power source through hoses 315. Each cylinder has a plunger 316 operably connected to an elongated needle carrier bar 318 having a pair of flanges or side bars 319. A plurality of needles 320 is connected to the carrier 318 in equally spaced locations along its length. A row of spring-loaded presser feet 322 is operably connected in lost-motion relationship to the carrier 318 through the side bars 319 by pairs of rods 324 which extend slidably through the side bars 319. The lower ends of each rod pair are connected to the opposite ends of a presser foot 322 and extend up through associated openings in the side bars 319. Each rod has a stop member 326 at the upper end thereof, and carries an encircling coil spring 328 acting in tension between the stop member and side bar 318. Feet 322 are thus gravity biased downwardly to drop a given distance below carrier 318 when in its raised position, and are further spring biased during their lost-motion retrograde relative travel on carrier 318 after engaging a folded bag during the downstroke of carrier 318.

A plurality of storage troughs 330 is supported on top of the housing to hold a supply of cord sections to be readily available to the operator for loading the needles from either side of the machine.

Figure 39:
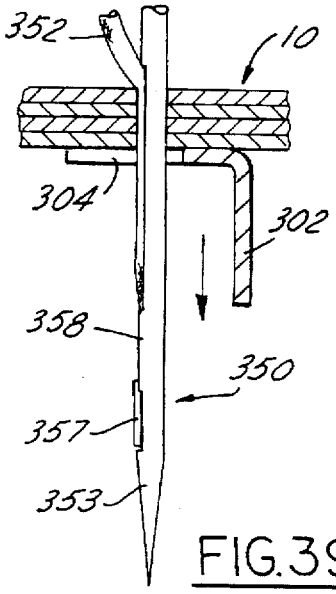
FIG. 39 is a view of the loaded needle at the end limit of its bag penetration stroke after having been punched through the folded bag.
Figure 40:
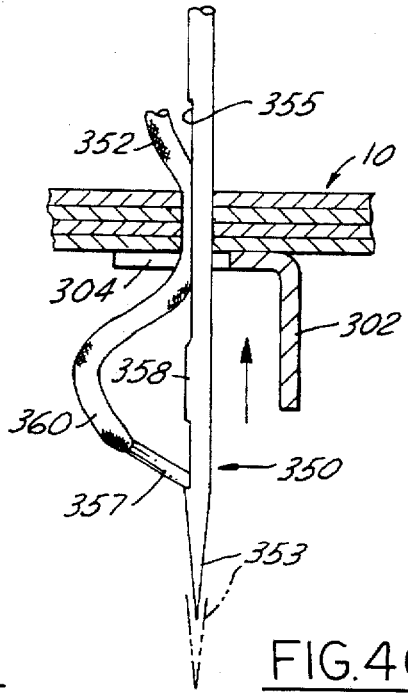
FIG. 40 is a view of the needle being withdrawn from the bag on its retraction stroke and illustrating the bag-penetrated free end of the cord being stripped from the needle.

FIGS. 34–40 show a needle 350 also constructed in accordance with the invention which is formed to force the cord section 352 from the needle as it is withdrawn from the bag. Each needle has a finely tapered conical point 353 merging into a shank 354. Shank 354 is formed with essentially a D-shaped configuration in radial cross section along a majority of its length (FIG. 35) to define a flat 355. Each needle flat 355 is formed at a lower portion thereof with a hollowed out or rectangular groove 356 dimensioned to snugly receive a special end tip 357 of the cord 352 in the lower end of the groove immediately above needle point 353- Shank 354 is also formed with a pinched or narrowed portion 358 (FIGS. 34, 36 and 38) which serves to catch and retain a portion of the squeezable woven cord 352 therein as well as a portion of the acetate tip 357 as the needle is driven into the bag (FIG. 39). This prevents the cord 352 as well as tip 357 from prematurely exiting the groove 356 (which receives and contains the entire acetate tip 357).

During the fabric penetration stroke of needle 350, the cord tip 357 and portion of the cord lying in groove 356 present, in conjunction with the portion of shank 354 coextensive therewith, an outside diameter only slightly larger than the shank diameter and hence readily penetrate the fabric following behind needle point. However, the portion of cord 352 lying against flat 355 protrudes a greater distance radially outwardly of the shank, and hence is tightly squeezed by flat 355 against the strands or plys of the bag fabric as it is dragged therepast to the end limit of the needle fabric penetration stroke shown in FIG. 39.

When the needle 350 is initially being withdrawn (FIG. 40), the friction between the cord and the bag is enough to hold the pinched cord section in place while the surface of flat 355 slides upwardly therepast with upward motion of needle 350. As tip 357 is carried upwardly by its lower end seating in groove 356, it is tipped out of the groove as the stationary run 360 of cord 352 is bulged outwardly away from the needle into the form of a half loop. This action pulls run 360 loose from the shank pinch portion 358. As the needle is withdrawn further upwardly from its position shown in FIG. 40, the further gathering and bulging of loop run 360 causes the cord tip 357 to finally pop out of the lower end of groove 358 of the needle, thereby fully disengaging the cord from the needle. As the needle continues to be withdrawn, the cord remains held in the bag as the groove 356 and point 353 slide upwardly therepast and are raised clear of the fabric on the needle retraction stroke.

The cord 352 shown in FIGS. 28 and 34–40 is a new type of cord which is used in forming the double knot loops. This cord is preferably of a polypropylene weave and has a tensile strength of approximately 170 lbs. One important feature of the cord is that each tip end 357 has a molded acetate, plastic shell encasing the woven fabric cord end. A simple end knot can then be hand tied just in back of the tip, and since the acetate tip is stiff, it will not allow the knot to advance to the free end of the cord, thus preventing the knot from loosening. Prior cords without the acetate tips have become untied, causing failure of the baffle system. Another advantage to this type of cord is that the polypropylene is less expensive than the prior Kevlar® cords, and has some elasticity which helps prevent the cord itself from breaking and/or tearing the fabric through which it is passed, as from bag drop stresses. This elasticity of the cord material also helps prevent injuring the fabric when the cord passes through it. Additionally, polypropylene cord is more readily recycled with the entire bulk bag because the material is common to the materials used in the bulk bag, whereas the Kevlar® cord is materially different and cannot be recycled therewith.

In use of stitching machine 290, an operator slides a folded bag 10 from the table 292 onto the open frame rails of the stitching machine to the desired stitching position. The bag is then initially held in place by actuating hand-operated toggle clamps 332 preferably located on each side of the stitching machine. Operators standing, one on each side of the stitching machine, can then pull a cord from the supply trough 330 and load each of the needles 320 located on their sidemachine machine. The double acting pneumatic cylinders 314 are then operated to move needles 320 downward so that the needles pierce the folded bag and extend therethrough to the downstroke end limit position of FIG. 39. Cylinders 314 then reverse and the needles 320 are then withdrawn, leaving the free end of each of the cord sections 282 and 284 stripped from the needles and dangling on the underside of the folded bag. Each operator can then grab these free ends of each cord section and pull it further on through so that there is an equal length of cord on each side of the folded bag. The end of each cord is then tied to the end of a laterally adjacent cord on both sides of the folded bag to form the double knot loop as seen in FIGS. 28 and 29.

This method of stitching the bags is faster and easier as it eliminates the step of reverse stitching as is necessary in forming a single knot loop (FIG. 18). Additionally, this method eliminates the step of having to double fold the bag in order to achieve a single stitch (FIG. 19). This method can be performed on any finished bag which can be gusseted as well as any unfinished bag.

Figure 41:
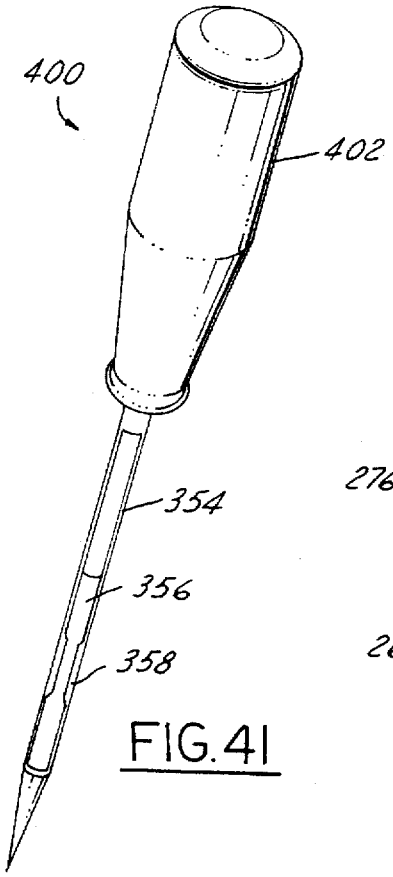
FIG. 41 is a perspective view of the needle of FIGS. 34–40 modified for individual manual use.

FIG. 41 shows a needle 400 that can be used to manually form loops in a bag. The needle is constructed essentially the same as the needles 320 with the exception of a handle 402 provided at an end thereof for easy manual grasping.

Figure 42:
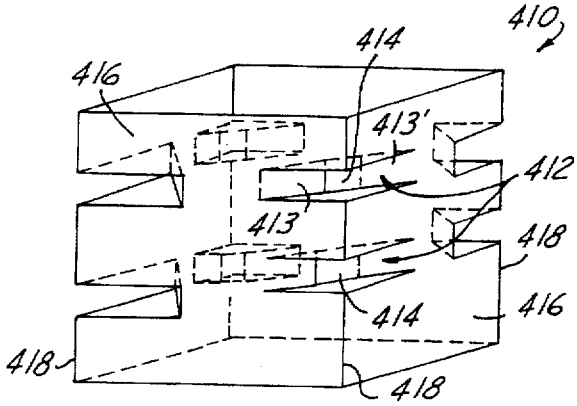
FIG. 42 is a perspective view of yet another embodiment of the bulk bag of the present invention.
Figure 43:
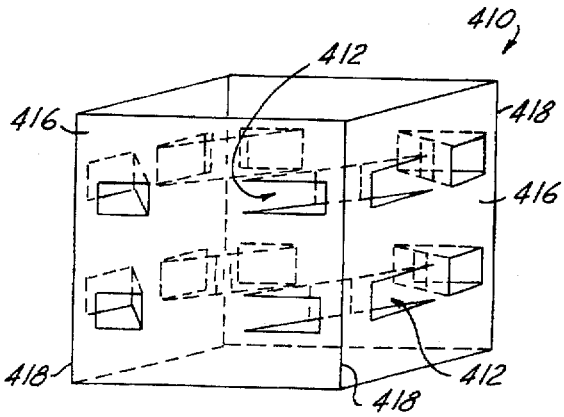
FIG. 43 is a perspective view of still another embodiment of the bulk bag of the present invention.
Figure 44:
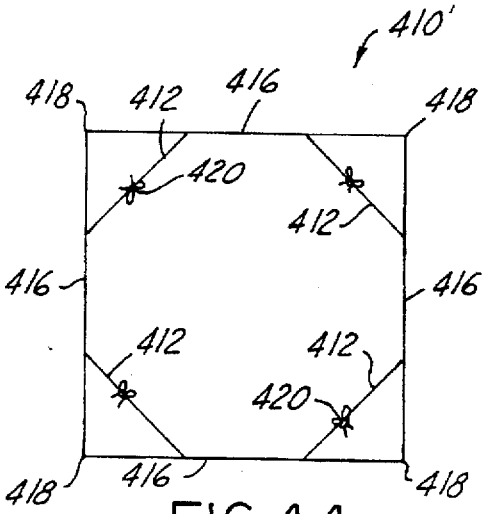
FIG. 44 is a top view of a further embodiment of the bulk bag of the present invention.

FIGS. 42–44 illustrate a modified liner 410 or bellyband construction having die cut gussets 412 formed by die cutting two strips 413,413' of sidewall material along two parallel spaced cut slits and at a transverse cut so that two gusset strips are cut from adjacent side walls with overlappable free ends. Strips 413,413' are thus integrally attached at one end to the bag sidewall from which they are cut. The cut free ends 414 thereof bonded, sewed, tied or otherwise secured together in overlapping relation in any desired manner. FIG. 42 shows each gusset strap 412 cut from the central portion of its associated sidewall 416 all the way to the associated corner 418 so that the cut free ends include the original cover material. FIG. 43 is similar to FIG. 42 except that the die cut in each sidewall 416 which forms the straps 412 do not extend all the way to the corner 418 thereby leaving the corner material intact and continuous. FIG. 44 is a top view of a liner 410' similar to either liner shown in FIGS. 42 and 43 but showing the ends secured together by tying a knot 420 in the mutually overlapped cut free ends of each pair of corner gussets.

Preferably, the die cut gussets 412 of the embodiments of FIGS. 42–44 are made about one inch in transverse width (maximum) and are spaced from the next adjacent gusset by at least seven or eight inches. The die cut gussets thus, like the previously described loops of cords, provide side wall anti-bulging tension-resistant restraints to resist the bulk material load stresses exerted on the bag sidewalls in use. Moreover, gussets 412, like the cord loops, are thin and widely spaced apart so as to not to impede or delay material flow therebetween during bag filling and dumping, and are also readily expandable and collapsible with the remainder of the bag during unfolding or folding operations, or when crumpling for disposal of the used bag itself.

Figure 45:
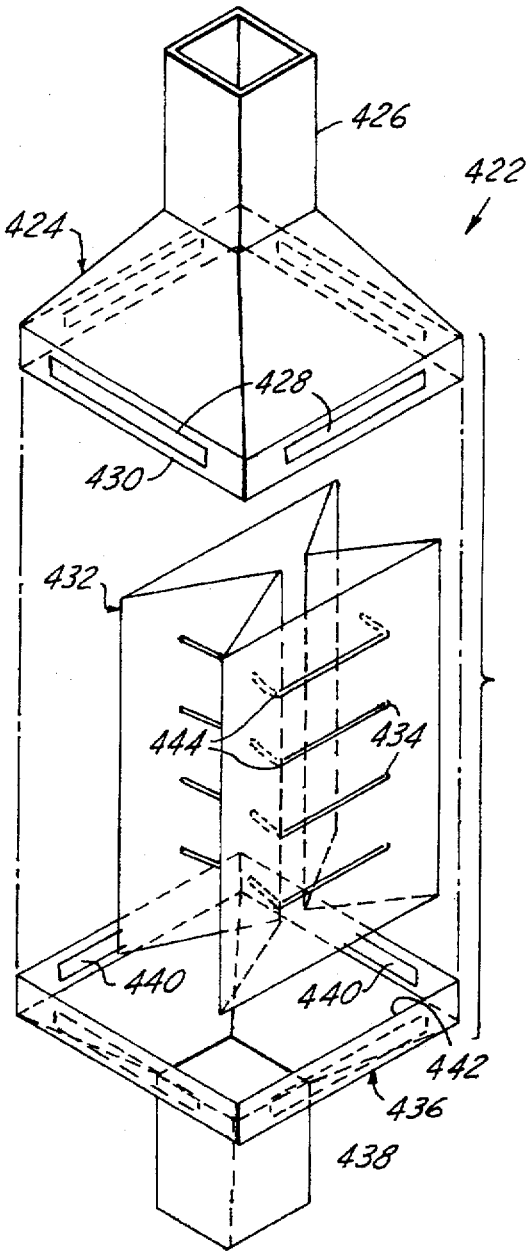
FIG. 45 is a perspective exploded view of yet a further embodiment of the bulk bag of the present invention.
Figure 46:
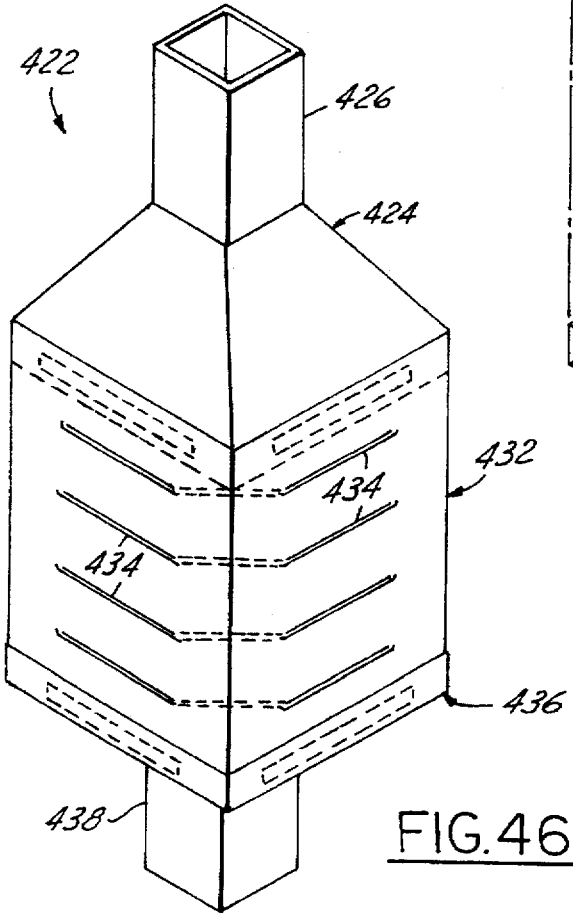
FIG. 46 is a view of the embodiment shown in FIG. 45 with the bulk bag shown assembled.

FIGS. 45 and 46 show yet another modified liner construction 422 comprising a form fitting top 424 having a spout 426 at one end (top, as shown) and made of a polypropylene or polyethylene film having a thickness in the range of about 4–10 mil. At the other or lower end of the top, a double sided tape 428 is applied as shown to the outside thereof adjacent the lower edge 430 of the top. A baffled open-ended middle gusset skirt 432 made of a woven coated fabric is provided having loops of cord 434 as previously described. A bottom 436 having a spout 438, and made from the same material, and in the same shape as top 424, is provided with double sided tape 440 applied, as shown to the inside surface of bottom 436 adjacent its upper edge 442. The assembled liner is formed by inserting the top 424 inside the baffled skirt 432 at one end so that the tape 428, which is secured to the outside of the top, bonds to the inside of the skirt. The skirt 432 is then inserted into the bottom 436 so that the tape 440, which is secured to the inside of the bottom, bonds to the outside of skirt 432. This assembled liner construction (FIG. 46) may then be stitched or secured to an open-ended bag, for example, a bag similar to bag 242 shown in FIGS. 23 and 24 but with the bottom 258 removed to accommodate the bottom spout 438. Of course, if desired, the bottom spout may not be used, in which case the liner with only the top spout 426 would be used with an open top bag, such as bag 252 in FIGS. 23 and 24. This construction allows a plurality of bellyband type liners, or at least the middle skirt part of multi-part bags, to be made from one long tubular blank which is first provided with transverse cord loops spaced along its entire length, and then cut to form multiple gusseted liners or middle skirts from an elongate web of flexible material. Each gusseted skirt is cut to the desired length depending on the size of the bag with which it is to be used. The top spout and, if desired, the bottom spout is then secured to the skirt to form the complete liner which is then attached to the bag, preferably by stitching at the corners thereof.

In certain instances where particulate or lump bulk solid material, and even extremely fine grained materials or powder, are to be contained, the assembled liner (FIG. 46) may be used as a bag itself. The coated woven fabric of the skirt tends to be self-sealing so that, for instance, if the loops of cord were not present, the holes 444 through which they extend would close. The material is strong enough so that the holes would tend to remain closed to prevent the material from leaking. As such, the skirt material provides good seal for solid material content at the holes through which the cord loops extend. Also, the polypropylene woven cord is elastic and hence does not tend to tear or rip the fabric at the holes. In addition, this cord material, as well as the bag material, tends to be "puffy" and form loose fiber strand ends or bunch-up in the vicinity or at the bag holes through which the cord loops pass, which also tend to stop leakage of solid material therethrough.

As used herein, and in the following claims, the term "bag" encompasses or includes what are sometimes termed liners, bag liners liners for bags or liner bags, which typically are made of a plastic film and in use frequently disposed inside an outer bag of a woven fabric or other relatively strong and flexible material, which supports the liner and carries the weight of the contents of the liner when it is filled.

In summary, a collapsible bulk bag is provided with a collapsible anti-bulging support construction which may comprise at least two loops of cord constructed and arranged such that when the bag is expanded and filled, the loops of cord restrain and substantially retard the sidewalls from bowing and bulging outwardly. In another embodiment, the anti-bulging support construction may be in the form of flexible corner gussets that extend obliquely one between each pair of adjacent sidewalls of the bag when the bag is filled. The gussets thus in general comprise an array of relatively widely spaced apart, flexible, lightweight, tension-resistant members of relatively thin cross-section, for example, cord webbing or integrally attached strips die cut from the bag itself.

The anti-bulging support construction may also be in the form of a bellyband having a collapsible array of flexible tension-resistant members of relatively thin cross-section constructed and arranged to provide relatively wide open spaces therebetween to retard bulging. The anti-bulging support construction may also be in the form of a composite liner or bellyband comprising a thin filmed top having a spout and secured to sidewalls of a bellyband or liner made of a coated fabric. If desired, a thin filmed bottom having a spout may also be provided and secured to the bellyband.

I claim:

1. A bulk bag comprising, a pair of end walls and at least two pair of sidewalls constructed and arranged so that when the bag is expanded and filled with material the sidewalls of each pair are in generally opposed relation and all the sidewalls extend between the end walls, all the sidewalls being of a flexible material, and at least two closed loops of cord associated with each pair of opposed sidewalls and being spaced apart between the end walls, each closed loop having first portions within the bag which when the bag is filled extend between its associated pair of opposed sidewalls and second portions operably connected with said associated opposed sidewalls so that when the bag is filled the loops of cord restrain and substantially retard the sidewalls from bowing and bulging outwardly from a generally planar configuration.

2. The bag of claim 1 wherein when the bag is full each loop of cord lies generally in a plane extending generally parallel to the bottom end wall of the bag with said first portions extending generally parallel to each other and merging into said second portions with said second portions passing through their associated sidewalls and extending along the outside thereof in central regions of such associated sidewalls.

3. A bulk bag comprising, a first member having at least two pair of sidewalls and a second member having at least two pair of sidewalls and at least one end wall, said first and second members being constructed and arranged so that the sidewalls of each pair are in generally opposed relation, all the sidewalls being of a flexible material, each sidewall having side edges and a central region between its side edges, wherein the sidewalls of one of said first and second members are nested within the sidewalls of the other of said first and second members so that the side edges of said first member are secured to the side edges of said second member at spaced locations, and sidewall anti-bulging means comprising at least two closed loops of cord which have first portions within the bag which when the bag is expanded and filled extend obliquely between each pair of adjacent sidewalls and second portions operably connected with each said pair of adjacent sidewalls in said central regions so that when the bag is expanded and filled the loops of cord restrain and substantially retard the sidewalls from bowing and bulging outwardly from a generally planar configuration.

4. The bag of claim 3 wherein the side edges of said first and second members are secured by stitching at each side edge adjacent the end walls of said first and second members.

5. The bag of claim 3 in which said at least two closed loops of cord are spaced apart and wherein when the bag is expanded and full, each loop of cord lies generally in a plane extending generally parallel to the end wall of said second member with said first portions extending generally obliquely between each said pair of adjacent sidewalls, said second portions passing through the sidewalls of said first member and extending between the sidewalls of said first and second members in central regions of said sidewalls.

6. The bulk bag of claim 3 wherein said second member comprises a middle baffled skirt made of coated woven fabric, said loops of cord being operably connected to said sidewalls of said skirt, and said at least one end wall is made of a thin film material having a spout and bonded to said sidewalls of said skirt.

7. The bulk bag of claim 6 wherein said second member comprises a second end wall made of a thin film material having a spout and bonded to said walls of said skirt.

8. In a bulk bag comprising, at least one end wall and at least two pair of side walls constructed and arranged so that the sidewalls of each pair are in generally opposed relation and all of the sidewalls extend from the perimeter of said one end wall, all the sidewalls being of a flexible material, each sidewall having side edges and a central region between its side edges, and a plurality of means secured one to each adjacent pair of sidewalls within the bag and when the bag is expanded and filled extending obliquely one between each pair of adjacent sidewalls to restrain and substantially retard the sidewalls from bowing and bulging outwardly from a generally planar configuration, the improvement in combination therewith wherein each of said means comprises an array of spaced apart flexible tension-resistant members each of relatively thin cross section constructed and arranged to provide relatively wide open spaces therebetween in each said array, said means being collapsible with said bag walls when the bag is empty.

9. A bulk bag of claim 8 wherein each of said means comprises cord webbing sections forming said tension resistant members and further comprises first and second spaced woven fabric strips with a plurality of said cord sections extending transversely therebetween, wherein each of said cord sections have opposed ends, each end of each said cord section extending through and being secured to an associated one of said fabric strips by a knot.

10. The bag of claim 9 wherein each of said means has one of said first and second fabric strips secured to an inside portion of one of said pair of adjacent sidewalls and the other of said first and second fabric strips secured to an inside portion of the other of said pair of adjacent sidewalls so that when the bag is expanded and full said cord sections extend generally obliquely between each said pair of adjacent sidewalls.

11. The bag of claim 10 wherein when the bag is full each said cord section extends generally parallel to the bottom end wall of the bag.

12. The bulk bag of claim 9 wherein each end of each of said cord sections has a molded plastic tip.

13. The bulk bag of claim 9 wherein each said cord section is made of a polypropylene weave.

14. The bag of claim 8 wherein each said means comprises a plurality of cord sections, each said cord section having first and second woven tabs wherein each cord section has opposed ends, each said end extending through and secured to one of said first and second tabs by a knot.

15. The bag of claim 14 wherein one of said first and second tabs is secured to an inside portion of one of said pair of sidewalls and the other of said first and second tabs is secured to an inside portion of the other of said pair of sidewalls so that when the bag is expanded and full said cord sections extend generally obliquely between mutually adjacent walls of each said pair of sidewalls.

16. The bag of claim 15 wherein the tabs on one of said pair of sidewalls are secured in vertical alignment and parallel to the tabs on the other 6f said pair of sidewalls so that when the bag is full each said cord section extends generally parallel to said one end wall of the bag.

17. A bulk bag anti-bulging support construction comprising a plurality of collapsible sidewalls made of a flexible material, each sidewall having side edges connected to a mutually adjacent side edge of an adjacent one of said sidewalls and each sidewall having a central region between its side edges, a plurality of flexible, collapsible tension-resistant supports attached to the central region of each sidewall such that when said bulk bag support construction is expanded and full of a bulk load, the supports extend obliquely between each pair of mutually adjacent sidewalls to restrain and substantially retard the sidewalls from bowing and bulging outwardly from a generally planar configuration, each of said supports comprising an array of spaced apart flexible tension-resistant members, each of relatively thin cross section and constructed arranged to provide relatively wide open spaces therebetween in each said support array, each said support array being collapsible with said sidewalls when said bulk bag support construction is empty.

18. The bulk bag support construction of claim 17 in which the plurality of supports comprise closed loops of cord each having a first portion extending obliquely between adjacent sidewalls and second portions connected with the adjacent sidewalls in the central region.

19. The bulk bag support construction of claim 17 in which the plurality of supports comprise cord webbing secured to adjacent pairs of sidewalls within the bag support construction which when the same is expanded and filled extend obliquely between each pair of adjacent sidewalls to restrain and substantially retard the sidewalls from bowing and bulging outwardly from a generally planar configuration.

20. The bulk bag support construction of claim 19 wherein each said cord webbing comprises first and second spaced woven fabric strips with a plurality of cord sections extending transversely therebetween, wherein each said cord sections have opposed ends, each end of each said cord section extending through and secured to one of said fabric strips by a knot.

21. The bulk bag support construction of claim 20 wherein one of said first and second fabric strips is secured to an inside portion of one of said pair of adjacent sidewalls and the other of said first and second fabric strips is secured to an inside portion of the other of said pair of adjacent sidewalls so that when the bag support construction is expanded and full said cord sections extend generally obliquely between each said pair of adjacent sidewalls.

22. The bulk bag support construction of claim 20 wherein each said cord webbing comprises a plurality of cord sections, each said cord section having first and second woven tabs wherein each cord section has opposed ends, each said end extending through and secured to one of said first and second tabs by a knot.

23. The bulk bag support construction of claim 22 wherein one of said first and second tabs is secured to an inside portion of one of said pair of sidewalls and the other of said first and second tabs is secured to an inside portion of the other of said pair of sidewalls so that when said bag support construction is expanded and full said cord sections extend generally obliquely between each said pair of adjacent sidewalls.

24. The bulk bag support construction of claim 23 wherein the tabs on one of said pair of sidewalls are secured in vertical alignment and parallel to the tabs on the other of said pair of sidewalls so that when said bag support construction is full each cord sections extend generally parallel to one another.

25. The bulk bag support construction of claim 17 wherein said tension-resistant members each comprise two strips of material die cut from the material of the associated adjacent sidewalls so as to each have one end integrally attached to the central region of its associated sidewall and a free end cut from or adjacent to the mutual side edge of said adjacent sidewalls, said free ends being overlapped with and secured to one another.

26. The bulk bag support construction of claim 25 wherein each said strip is die cut from said central region of each said sidewall to a position adjacent but short of said mutual side edge.

* * * * *